US010186238B2

(12) United States Patent
Spangler et al.

(10) Patent No.: US 10,186,238 B2
(45) Date of Patent: Jan. 22, 2019

(54) TRAVEL GUITAR

(71) Applicant: Ciari Guitars, Inc., San Diego, CA (US)

(72) Inventors: Jonathan D Spangler, San Diego, CA (US); James Coleman Lee, Carlsbad, CA (US)

(73) Assignee: Ciari Guitars, Inc., San Diego, CA (US)

( * ) Notice: Subject to any disclaimer, the term of this patent is extended or adjusted under 35 U.S.C. 154(b) by 0 days.

(21) Appl. No.: 15/243,922

(22) Filed: Aug. 22, 2016

(65) Prior Publication Data

US 2018/0053491 A1 Feb. 22, 2018

(51) Int. Cl.

| | |
|---|---|
| ***G10D 1/08*** | (2006.01) |
| ***G10D 3/06*** | (2006.01) |
| ***G10H 3/18*** | (2006.01) |
| ***G10H 1/32*** | (2006.01) |
| ***G10G 1/04*** | (2006.01) |

(52) U.S. Cl.

CPC ..... *G10D 1/08* (2013.01); *G10D 3/06* (2013.01); *G10G 1/04* (2013.01); *G10H 1/32* (2013.01); *G10H 3/18* (2013.01); *G10H 3/186* (2013.01); *G10H 2220/096* (2013.01); *G10H 2230/015* (2013.01); *G10H 2240/281* (2013.01)

(58) Field of Classification Search

USPC ..... 84/293, 743

See application file for complete search history.

(56) References Cited

U.S. PATENT DOCUMENTS

| | | | | |
|---|---|---|---|---|
| 3,910,152 | A * | 10/1975 | Kusakawa | G10D 3/143 84/307 |
| 4,111,093 | A * | 9/1978 | Field | G10D 1/08 84/267 |
| 4,385,543 | A * | 5/1983 | Shaw | G10D 3/04 84/298 |
| 8,288,637 | B2 * | 10/2012 | Kingsley | G10D 3/143 84/312 P |
| 8,710,346 | B2 * | 4/2014 | Behringer | G10H 1/0008 84/615 |
| 2007/0056429 | A1 * | 3/2007 | Poschelk | G10D 1/08 84/293 |

* cited by examiner

*Primary Examiner* — Christopher Uhlir

(74) *Attorney, Agent, or Firm* — Jonathan D. Spangler

(57) ABSTRACT

A travel guitar having a neck and/or body that may assume a reduced profile configured to house or otherwise receive or coupled to a tablet computer (e.g. iPad by Apple, Inc.) and/or a smart phone (e.g. iPhone by Apple, Inc.) having one or more applications (apps) for driving the operation, functionality and/or effects associated with the travel guitar, and a string assembly capable of retracting or otherwise housing the strings to enable or facilitate configuring the travel guitar into a reduced profile.

11 Claims, 22 Drawing Sheets

TRAVEL GUITAR

CROSS REFERENCES TO RELATED APPLICATIONS

The present application is a non-provisional patent application claiming priority to U.S. patent application Ser. No. 13/831,810 filed Mar. 13, 2013, which claims the benefit under 35 U.S.C. § 119(e) from U.S. Provisional Application Ser. No. 61/685,760, filed on Mar. 24, 2012, the entire contents of which are hereby expressly incorporated by reference into this disclosure as if set forth fully herein.

BACKGROUND OF THE INVENTION

I. Field of the Invention

The present invention relates generally to guitars and, more particularly, to travel guitars (i.e. guitars capable of being played anywhere, but configured to assume a reduced profile for ease of travel).

II. Discussion of the Prior Art

Guitars have enjoyed among the highest popularity among stringed instruments. Most guitars have a solid neck rigidly coupled to either a hollow or solid body. This construction, while aiding in predictable tuning and quality guitar play, render the guitar cumbersome for travel (e.g. air, train, auto, etc. . . . ), particularly given the additional bulk of the associated guitar case (hard or soft). While various travel guitars have been attempted, most are simply smaller or scaled down versions of their traditional counterparts, which still present challenges for travel and/or predictable tuning and quality guitar play. The present invention is directed at overcoming, or at least improving upon, the disadvantages of the prior art.

SUMMARY OF THE INVENTION

The present invention accomplishes this goal by providing a travel guitar wherein at least one of the neck and body may assume a reduced profile.

According to one aspect, the travel guitar may be configured to house or receive or otherwise couple to a tablet computer (e.g. iPad by Apple, Inc.) and/or a smart phone (e.g. iPhone by Apple, Inc.) having one or more applications (apps) for driving the operation, functionality and/or effects associated with the travel guitar.

According to one aspect, portions of the body and/or neck may be telescoping to facilitate configuring the travel guitar into a reduced profile. According to one aspect, portions of the neck may be foldable to facilitate configuring the travel guitar into a reduced profile.

According to one aspect, the travel guitar may be configured having a string assembly having a string spool configured to retract or otherwise receive or house at least a portion of the guitar strings within the body and/or neck to enable or facilitate configuring the travel guitar into a reduced profile.

According to one aspect, the travel guitar may be configured having a string assembly configured to retract or otherwise receive or house at least a portion of the guitar strings and capable of being selectively removed from the neck and/or body to enable or facilitate configuring the travel guitar into a reduced profile.

According to one aspect, the string assembly may include a detachable guitar head capable of being selectively attached and detached from the upper end of the neck of the travel guitar. When detached from the neck, the strings (or a portion thereof) and head may be coiled or otherwise nested near the body or, alternatively, retracted or otherwise received on a string spool (housed within the body or detachable from the body) to facilitate a reduced profile for the travel guitar.

According to one aspect, the string assembly may include a string spool housed within or otherwise capable of being coupled to the body of the travel guitar. The string spool is capable of retracting or otherwise receiving at least a portion of the strings while the travel guitar is in a reduced profile. The string spool may be spring-loaded, motor-driven, or manually operated to spool the strings. When implemented with a detachable head, the string spool may accept the strings (or a portion thereof) such that the detached head is capable of being situated at or near the string spool (whether disposed on-board the body or detached from the body) to enable or facilitate a reduced profile for the travel guitar.

In another aspect, the travel guitar may be configured such that the bridge assembly and/or string spool (if implemented) can be translated longitudinally towards the head of the guitar to allow sufficient de-tensioning of the guitar strings to enable an upper portion of the neck to be folded away from a lower portion of the neck and/or body to assume a reduced profile. When it is desired to deploy the travel guitar for playing, the upper portion of the neck may be unfolded into alignment with the lower portion of the neck and/or body, and the bridge assembly and/or spool assembly translated longitudinally away from the head and locked in position to allow the guitar to be tuned for playing. The longitudinal translation of the bridge assembly and/or spool assembly may be accomplished in any number of suitable translation mechanisms, including but not limited to coupling the bridge assembly and/or spool assembly to slidable rail(s) within the travel guitar and/or slidable plate(s) on the surface of the travel guitar, etc. . . . In one aspect, one or more pick-ups may be translated longitudinally with the bridge assembly and/or spool assembly.

In another aspect, the travel guitar may be configured with one or more translating truss rods housed within at least a portion of the neck to bolster its strength and rigidity for more accurate and prolonged tuning and fret alignment.

In one aspect, the translating truss rods are rigid, unitary structures capable of being translated longitudinally within one or more passageways formed in the upper portion and/or lower portion between a locked position and an unlocked position. In the locked position, each unitary truss rod is disposed at least partially within both the lower portion and upper portion of the neck, which locks the upper neck portion in alignment with the lower neck portion. In the unlocked position, each unitary truss rod is disposed within the lower neck portion and/or body portion, and removed from the upper neck portion, which unlocks the upper neck portion and thereby allows it to be folded into a reduced profile.

In one aspect, the translating truss rods are rigid, hinged structures capable of being translated longitudinally within one or more passageways formed in the upper portion and/or lower portion between a locked position and an unlocked position. Each truss rod is constructed from a rigid upper portion hingedly coupled to a rigid lower portion. In the locked position, the upper portion of each hinged truss rod is disposed at least partially within the upper portion of the neck, the lower portion of each hinged truss rod is disposed at least partially within the lower portion of the neck, and the hinge or hinged section is disposed within either the upper portion or lower portion of the neck. By disposing the hinged portion of the truss rod in the upper or lower portion of the neck, strut can no longer hinge and thus has strength and rigidity characteristics similar to that of a unitary truss rod. In the unlocked position, the upper portion of each hinged truss rod is disposed at least partially within the upper portion of the neck, the lower portion of each hinged truss rod is disposed at least partially within the lower portion of the neck, and the hinge or hinged section is disposed at the approximate junction or joint between the upper portion and lower portion of the neck. By disposing the hinge or hinged section of the truss rod at the approximate junction or joint between the upper and lower section of the neck, the upper section of the neck may then be folded to assume a reduced profile.

Each truss rod (unitary or hinged) may be translated with or independent of the translating bridge assembly and/or spool assembly. If translated with the bridge assembly and/or spool assembly, each unitary truss rod will be moved in the opposite direction as the bridge assembly and/or spool assembly, while each hinged truss rod may be translated in the either the same or opposite direction as the bridge assembly and/or spool assembly. The translation of each truss rod (unitary or hinged) may occur simultaneous with the translation of the bridge assembly and/or spool assembly, or slightly staggered in time. Staggering translation to assume a reduced profile first involves translating the bridge assembly and/or spool assembly towards the neck of the guitar in order to reduce the tension of the guitar strings, followed by translating each truss rod into the unlocked position such that the upper neck portion may be folded towards the lower neck portion. Staggering translation during deployment of the travel guitar first involves translating each truss rod into the locked position after the upper neck portion and lower neck portion have been brought into alignment, followed by translating the bridge assembly and/or spool assembly away from the neck of the guitar in order to increase the tension of the guitar strings in preparation for tuning.

Each truss rod may be constructed from a material having properties sufficient to bolster the strength and rigidity of the neck of the travel guitar, including but not limited to metal, carbon fiber, etc. . . . Each truss rod may be manufactured having any number of solid cross-sectional shapes (e.g. circular, oval, triangular, etc. . . . ) and/or non-solid cross-sectional shapes (e.g. generally crescent-shaped, generally V-shaped, generally U-shaped, etc. . . . ). If configured having a non-solid cross-sectional shape, the "open" side of the truss rod may be disposed within the neck so as to face generally towards the underside of the neck (versus towards the fret board). This configuration will provide the greatest strength and rigidity for the strut to resist the tendency of the neck to bend under the tension of the guitar strings after they have been tuned.

BRIEF DESCRIPTION OF THE DRAWINGS

Many advantages of the present invention will be apparent to those skilled in the art with a reading of this specification in conjunction with the attached drawings, wherein like reference numerals are applied to like elements and wherein.

DESCRIPTION OF THE PREFERRED EMBODIMENT

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. The travel guitar disclosed herein boasts a variety of inventive features and components that warrant patent protection, both individually and in combination.

Figure 1:
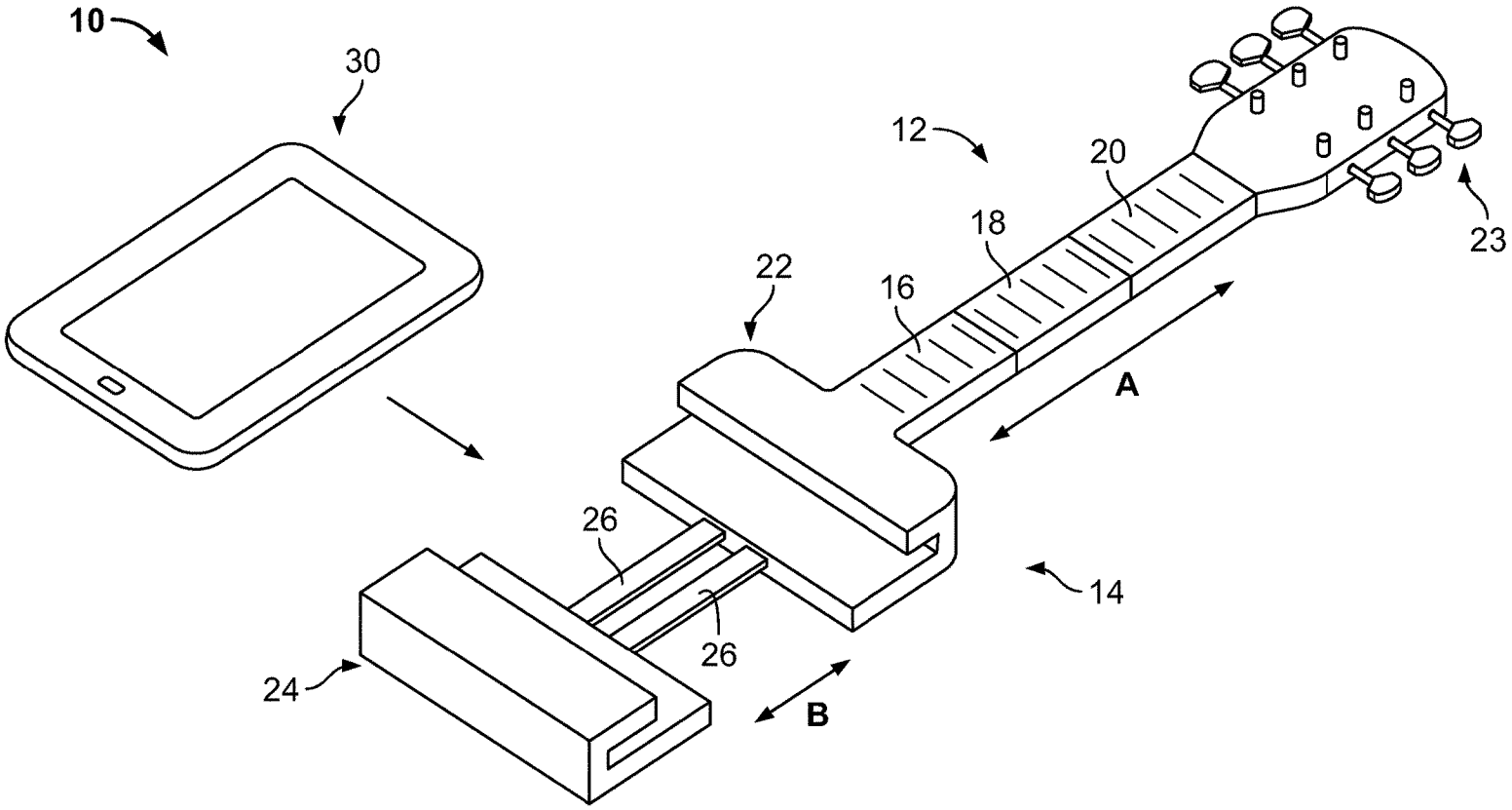
FIG. 1 is a perspective view of a travel guitar according to one aspect, with both a neck and body configured to assume a reduced profile due to telescoping construction, and an exemplary tablet computer (e.g. iPad) having one or more applications (apps) for driving the operation, functionality and/or effects associated with the travel guitar.

FIG. 1 illustrates a travel guitar 10 according to one aspect. The travel guitar 10 includes a neck 12 and a body 14. The neck 12 and body 14 are each configured to assume a reduced profile by virtue of their telescoping construction. The telescoping functionality of the neck 12 is accomplished by constructing the neck 12 from a plurality of neck portions, in this case (by way of example only) lower neck portion 16, middle neck portion 18, and upper neck portion 20, wherein (as will be described in detail below) the middle and upper neck portions 18, 20 can be telescoped into or otherwise towards lower neck portion 16. The telescoping action of neck 12 is represented generally by arrow A. The neck portions 16, 18, 20 may be equipped with locking features (not shown) to lock the portions 16, 18, 20 relative to one another upon being fully expanded as shown in FIG. 1.

The telescoping functionality of the body 14 is accomplished by constructing the body 14 from an upper base unit 22 and lower base unit 24, wherein (as will be described in detail below) the lower base unit 24 can telescope relative to the upper base unit 22 by virtue of arms 26 extending there between. The telescoping action of body 14 is represented generally by arrow B. According to one aspect, the lower base unit 24 may be spring-loaded relative to the upper base unit 22 such that the lower base unit 24 may be moved a sufficient distance away from the upper base unit 22 in order to receive a tablet computer 30, after which point the spring loading will draw the lower base unit 24 back towards the upper base unit 22 in order to help capture or retain the tablet computer 30 to enable its use as part of the travel guitar 10.

The travel guitar 10 is configured to receive or otherwise be coupled to the tablet computer 30 (and/or a smart phone, not shown in FIG. 1) having one or more applications (apps) for driving the operation, functionality and/or effects associated with the travel guitar 10. By way of example only, an exemplary tablet computer 30 (e.g. iPad) is shown in FIG. 1, wherein the base 14 is configured to receive the tablet computer 30 at least partially in between the upper base unit 22 and lower base unit 24 as described above.

The upper base unit 22 and/or lower base unit 24 may contain any of a variety of electronics for driving the operation, functionality and/or effects associated with the travel guitar 10, in addition to or in lieu of the capabilities or functionalities of the apps from the tablet computer 30 and/or smart phone (not shown). Such electronics may include, but is not necessarily limited to, pick-ups (e.g. coil-based and/or microphone-based), electrical connectors and/or circuitry for amplifiers, headphones, MIDI, connecting with external computers/tablets/smart phones, and power (AC and/or DC), etc. . . . In one aspect, the travel guitar 10 may be equipped with a number of servo motors (not shown) to automate the movement or adjustment any of a variety of components, including but not limited to: (a) adjusting the tuning machines 23 on the neck 12 to help tune the travel guitar 10; (b) rotating the string spool described below to help retract or otherwise house the guitar strings to enable or facilitate configuring the travel guitar 10 into a reduced profile (and vice versa); (c) adjusting the height of the individual frets 36 and/or bridge on the body 14 and/or nut on the head of the neck 12 to aid in the tuning the travel guitar 10 and/or adjusting the action of the strings 32 according to user preference; and (d) telescoping or otherwise moving the neck 12 and/or body 14 to configure the travel guitar 10 into a reduced profile for travel and an expanded profile for playing.

Although strings are not shown in FIG. 1, but it will be appreciated and clearly set forth below that the travel guitar 10 includes strings, which has the advantage of allowing a user to enjoy a true guitar planning experience, not only from the action of the user's fingers against the strings along the neck, but also due to the physical picking and/or strumming of the actual strings. In this manner, the travel guitar 10 is particularly suited to help a user consistently practice, irrespective of travel schedule, in that the ability of the travel guitar 10 to assume a reduced profile allows it to be easily transported, while at the same time providing a true "string-based" experience notwithstanding the fact the travel guitar 10 is electronic in nature being operated or enabled at least in part by a tablet computer and/or smart phone.

This can be seen in FIGS. 2-5, wherein a set of strings 32 extends between a head 34 of the neck 12 and the lower base unit 24 passing over a plurality of frets 36 disposed along the neck 12. In the fully extended configuration (shown in FIGS. 2 and 4), the strings 32 pass over lower, middle and upper sections 16, 18, 20 of the neck 12, as well as the upper base unit 22 and gap 40 (extending between upper and lower base units 22, 24) before terminating within the lower base unit 24.

Figure 3:
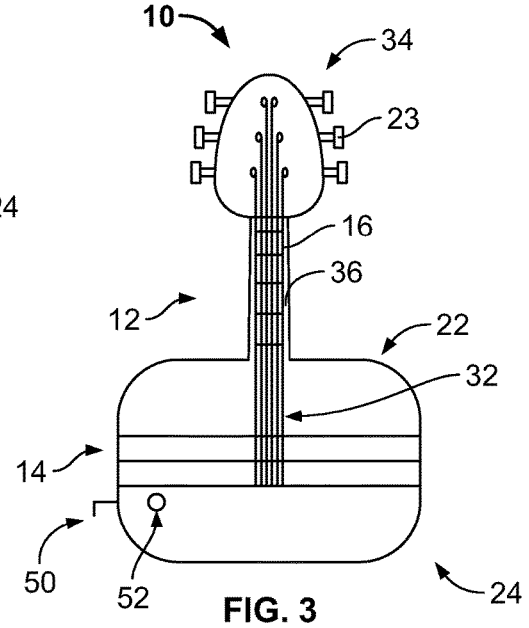
Figure 5:
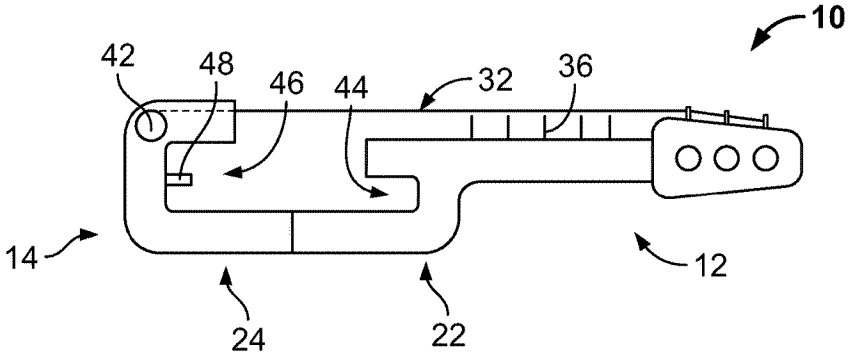

According to one aspect of the present invention, the lower base unit 24 is equipped with a string spool 42 configured to house the terminal ends of the guitar strings 32 and selectively retract or otherwise receive the strings 32 into the lower base unit 24 to facilitate configuring the travel guitar 10 in a reduced profile (shown in FIGS. 3 and 5). The strings 32, head 34 and string spool 42 collectively form a string assembly.

To enable amplification and/or recording, the travel guitar 10 may be equipped with any number of picks-up, whether coil-based and/or microphone-based and/or any others currently available or later developed. By way of example only, one or more coil-based pick-up (not shown) may be disposed within or otherwise associated with the lower base unit 24 and/or upper base unit 22 for purposes of picking up the vibration generated by wire-wound strings 32 passing over or near the coil-based pick-ups. Similarly, one or more microphone-based pick-up may be disposed at, on or near the lower base unit 24 and/or upper base unit 22 (e.g. adjacent the gap 40) for purposes of picking up the sound generated by wire-wound or nylon strings 32 passing near the microphone-based pick-up.

Figure 2:
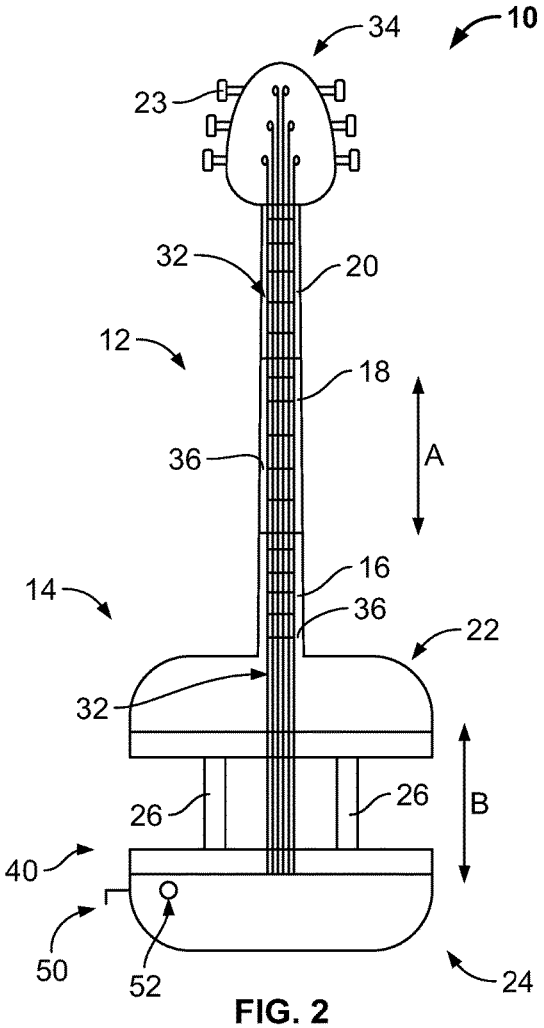
FIGS. 2-3 are front views of the travel guitar of the type shown in FIG.1 in an expanded profile (FIG. 2) and reduced profile (FIG. 3), respectively, with a string assembly configured to retract or otherwise receive or house the guitar strings to enable or facilitate configuring the travel guitar into the reduced profile.
Figure 4:
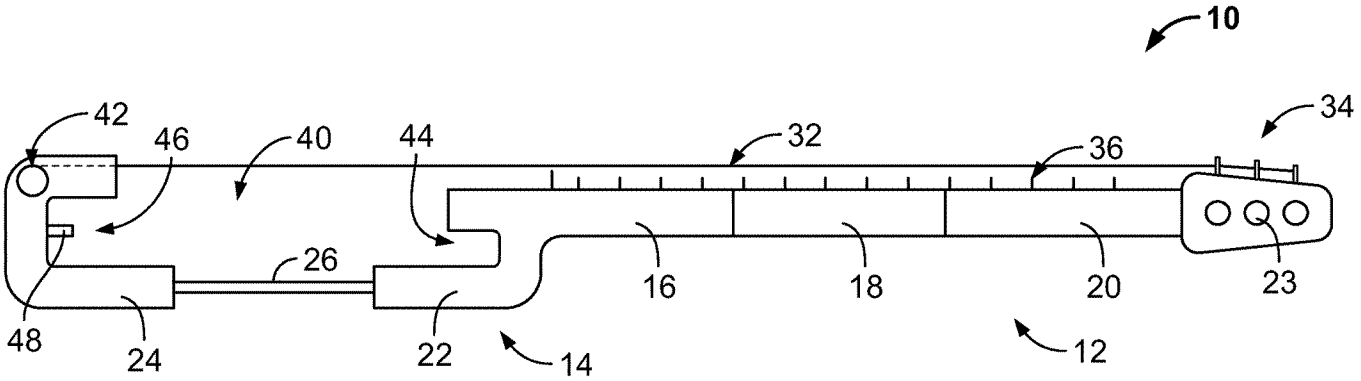
FIGS. 4-5 are side views of the travel guitar of the type shown in FIGS. 1-3 in an expanded profile (FIG. 4) and reduced profile (FIG. 5), respectively, wherein the string assembly includes a string spool disposed within the body to retract or otherwise receive the guitar strings to enable or facilitate configuring the travel guitar into the reduced profile.

The travel guitar 10, when in a reduced profile (FIGS. 3 and 5), is substantially smaller than when in a fully expanded configuration (FIGS. 2 and 4). This advantageously allows the travel guitar 10 to be carried or otherwise transported in a substantially more convenient manner than traditional guitars and existing travel guitars. The reduced profile of FIGS. 3 and 5 is enabled by the telescoping construction of the neck 12 and the body 14 according to an aspect of the invention.

The telescoping action of the neck 12 and/or the body 14 may be manual, automated or a combination thereof. For example, manual telescoping of the neck 12 may be accomplished by moving by hand the upper section 20 and middle section 18 downward into a nested position within the lower section 16 (and vice versa). This telescoping action may be facilitated by enabling the frets 36 to be retracted within the respective section of the neck 12 when telescoping action is desired to configure the travel guitar 10 into a reduced profile. Manual telescoping of the body 14 may be accomplished by moving by hand the lower base unit 24 over the arms 26 towards the upper base unit 22 (and vice versa). Automated telescoping may be accomplished, for example, by performing those actions by actuating one or more servo motors housed within or coupled to the neck 12 and the body 14. Actuation of the servo motors (not shown) may be accomplished via the on-board electronics and/or apps contained on the tablet computer 30 and/or smart phone (not shown). The string spool 42 facilitates the process of configuring the travel guitar 10 in a reduced profile by retracting or otherwise receiving the lower section of the strings 32 within the lower base unit 24. This also advantageously prevents the need to remove the strings 32 from the travel guitar 10 during storage or travel, which increases the convenience of the travel guitar 10. The operation of the string spool 42 may be manual or automated or a combination thereof.

Manual operation may be accomplished, for example, by providing an external crank 50 coupled to the string spool 42 disposed within the lower base unit 24 operable to rotate the string spool 42 to retract or otherwise receive the lower section of the strings 32 within the lower base unit 24 (and vice versa). The crank 50 may be coupled to the string spool 42 is any number of manners, including fixed, hinged, and removable.

Automated operation may be accomplished, for example, by providing one or more servo motors (not shown) within or otherwise associated with the lower base unit 24 and operable (via, for example, a switch 52) to rotate the string spool 42 to retract or otherwise receive the lower section of the strings 32 within the lower base unit 24 (and vice versa).

In either embodiment (automated or manual), the string spool 42 may be equipped with any of a variety of springs for adding tension to the strings 32 for the purpose of drawing them into the base unit 24 while bringing the guitar 10 into a reduced profile and enabling an orderly dispensing of the strings 32 from the string spool 42 while bringing the guitar 10 into the fully expanded profile for use.

Although not shown in FIGS. 2 and 4, it will be appreciated that the tablet computer 30 of FIG. 1 is configured to be retained by the upper base unit 22 and lower base unit 24. With reference to FIG. 4, this is accomplished by forming the upper base unit 22 with a groove 44 configured to receive one end of the tablet computer 30 and the lower base unit 24 with a groove 46 configured to receive an opposite end of the tablet computer 30. The upper base unit 22 and lower base unit 24 may be provided in any number of different shapes than that shown depending upon the size and shape of the tablet or smart phone device used with the guitar 10. Any of a variety of electrical connectors may be provided for connecting the tablet computer 30 to the base 14 in order to connect it to on-board electronics within or coupled to the travel guitar 10 to drive or augment the operation of the travel guitar 10. By way of example, a tablet connector 48 (e.g. proprietary Apple connector for iPad, iPhone, etc. . . . ) may be provided within the groove 46 of the lower base unit 24. Once connected, any of a variety of apps on the tablet computer 30 may be employed to help drive the operation, functionality and/or effects associated with the travel guitar 10.

Figure 6:
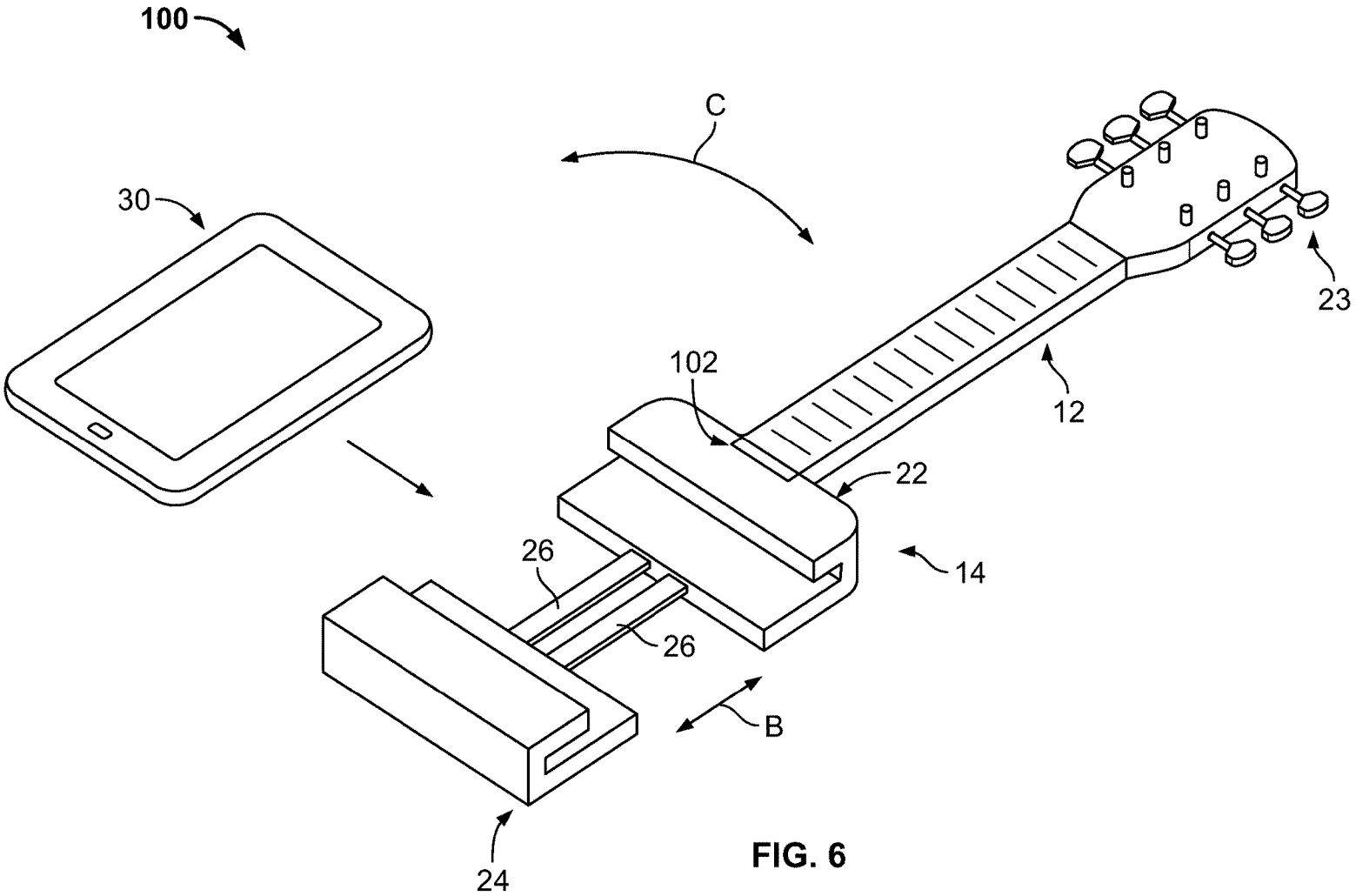
FIG. 6 is a perspective view of a travel guitar according to one aspect, with both a neck and body configured to assume a reduced profile due to hinged and telescoping construction, respectively, and an exemplary tablet computer (e.g. iPad) having one or more applications (apps) for driving the operation, functionality and/or effects associated with the travel guitar.
Figure 7:
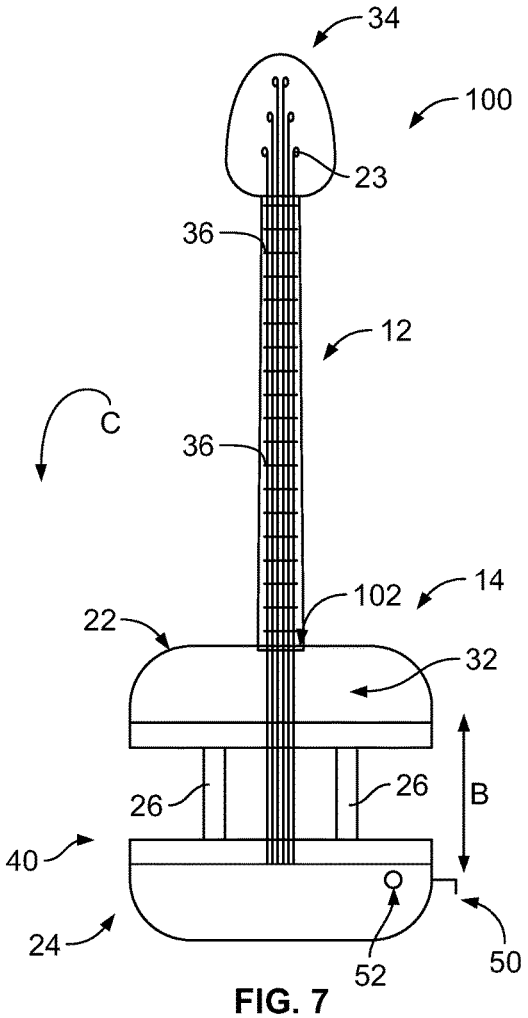
FIGS. 7-8 are front views of the travel guitar of the type shown in FIG.6 in an expanded profile (FIG. 7) and reduced profile (FIG. 8), respectively, with a string assembly configured to retract or otherwise receive or house the guitar strings to enable or facilitate configuring the travel guitar into the reduced profile.
Figure 8:
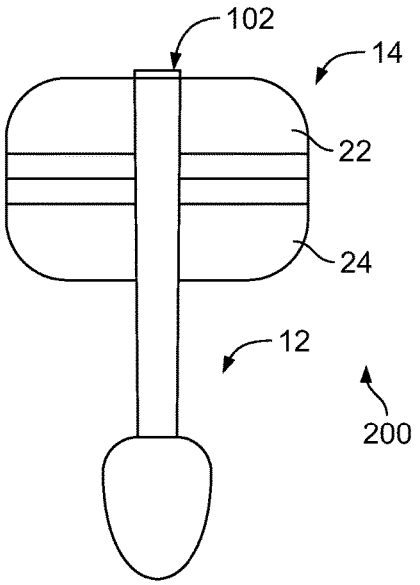
Figure 9:
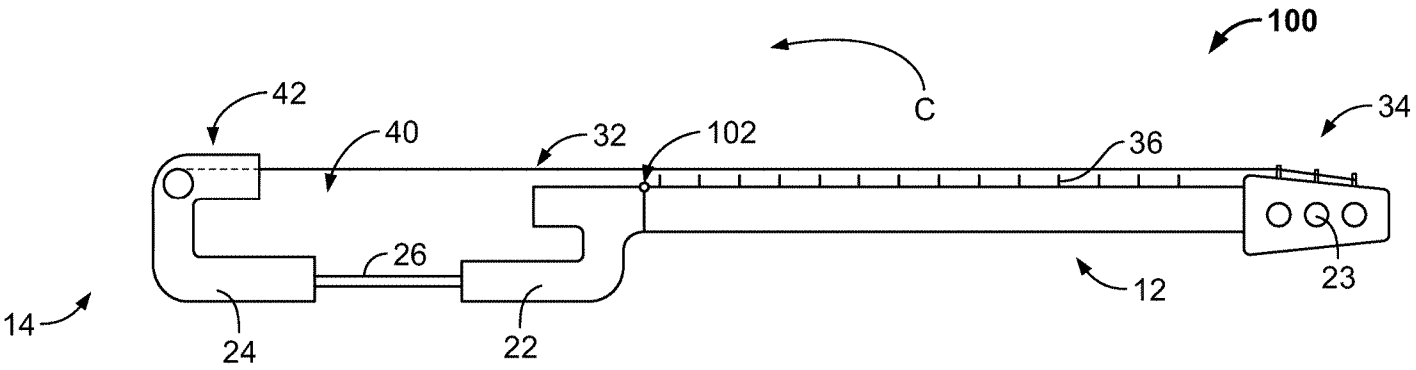
FIGS. 9-10 are side views of the travel guitar of the type shown in FIGS. 6-8 in an expanded profile (FIG. 9) and reduced profile (FIG. 10), respectively, wherein the string assembly includes a string spool disposed within the body to retract or otherwise receive the guitar strings to enable or facilitate configuring the travel guitar into the reduced profile.
Figure 10:
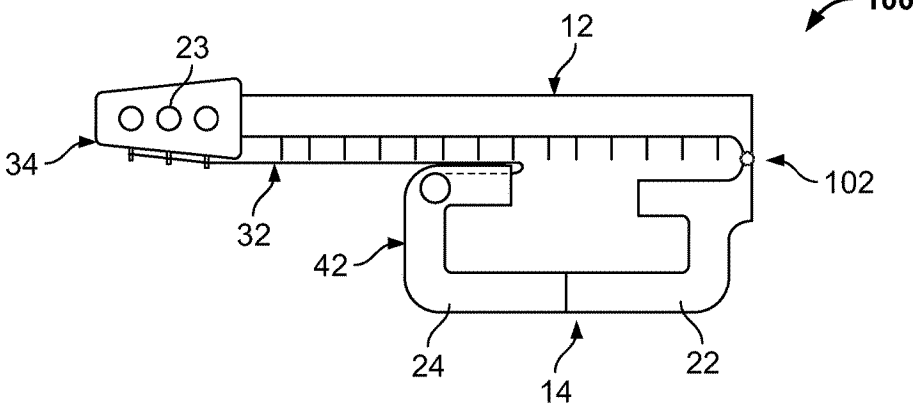

FIG. 6 illustrates a travel guitar 100 according to another aspect. The travel guitar 100 is virtually identical in construction to the travel guitar 10 of FIGS. 1-5, except that the neck 12 is hingedly coupled to the body 14 via a hinge 102 (vs. the telescoping neck 12 in FIGS. 1-5). Based on the commonality of construction and components, and for the sake of brevity, only those features and functions varying from the travel guitar 10 of FIGS. 1-5 will be described. The neck 12 is of unibody construction. The hinged motion of the neck 12 about the hinge 102 is represented generally by the arrow C. With reference to FIGS. 7-10, this hinged motion allows the neck 12 to rotate approximately 180 degrees such that the head 34 and part of the neck 12 extends beyond the lower base unit 24. This hinged action of the neck 12, together with the telescoping construction of the body 14, allows the travel guitar 100 to assume a reduced profile according to the present invention. Although not shown, it will be appreciated that the body 14 may be configured or formed with a recess formed longitudinally along its upper surface having a shape corresponding to the shape of the neck 12, such that the neck 12 may be nested at least partially within the top surface of the body 14 to lower the overall height profile of the travel guitar 100. The ability to nest the neck 12 in this manner may be augmented by altering the operation or location of the hinge 102 (e.g. disposing the hinge 102 below the top surface of the neck 12).

Figure 13:
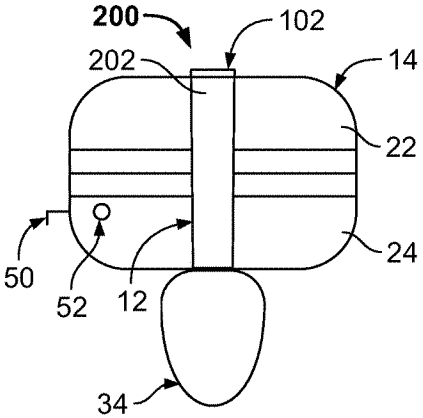
FIGS. 12-13 are front views of the travel guitar of the type shown in FIG. 11 during the process of assuming a reduced profile, with FIG. 12 illustrating the result after moving the hinged section of the neck and with FIG. 13 illustrating the result after moving the telescoping section of the neck.
Figure 12:
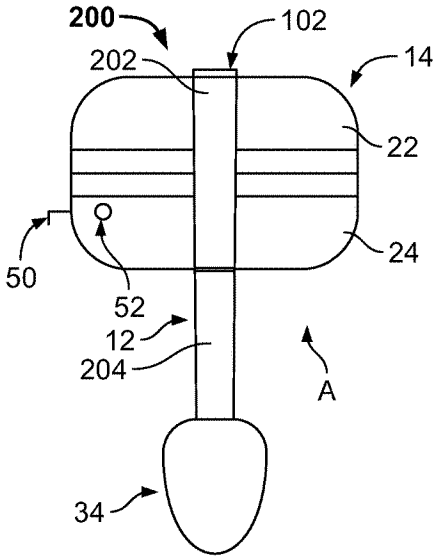
Figure 14:
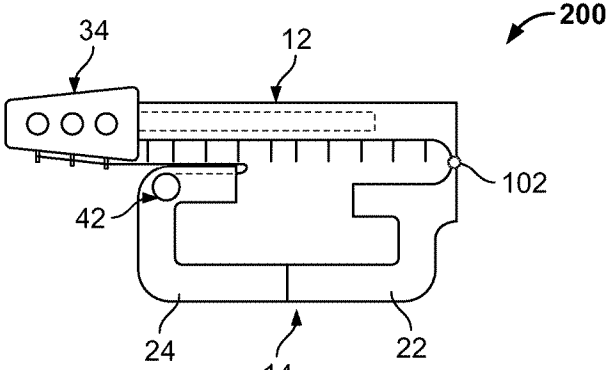
FIG. 14 is a side view of the travel guitar of the type shown in FIGS. 11-13 in a fully reduced profile, wherein the string assembly includes a string spool disposed within the body to retract or otherwise receive the guitar strings to enable or facilitate configuring the travel guitar into the reduced profile.
Figure 11:
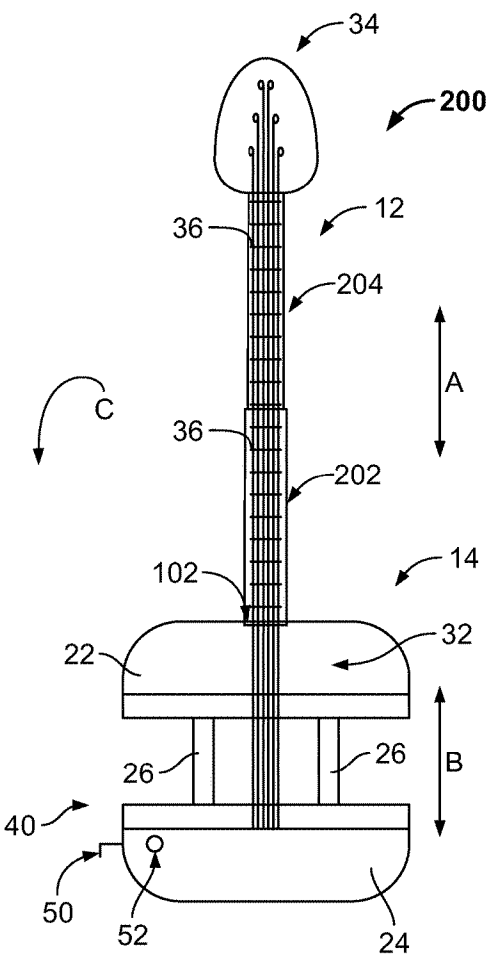
FIG. 11 is a front view of a travel guitar according to one aspect, wherein the neck has a combined telescoping and hinged construction and the body has a telescoping construction to collectively facilitate configuring the travel guitar in a reduced profile.

FIG. 11 illustrates a travel guitar 200 according to another aspect. The travel guitar 200 is virtually identical in construction to the travel guitar 100 of FIGS. 6-10, except that the neck 12 is not only hingedly coupled to the body 14 via hinge 102, but also includes a telescoping neck 12 (akin to those shown in FIGS. 1-5). Based on the commonality of construction and components, and for the sake of brevity, only those features and functions varying from the travel guitar 100 of FIGS. 6-10 will be described. The neck 12 is of telescoping construction, with a lower section 202 and an upper section 204. With reference to FIGS. 12-14, the hinged motion enabled by hinge 102 allows the neck 12 to rotate approximately 180 degrees such that the head 34 and part of the neck 12 extends beyond the lower base unit 24. The upper section 204 of the neck 12 may thereafter be moved in a telescoping manner into the lower section 202 (FIGS. 12-13). Although shown in this progression, it will be understood that the upper section 204 of the neck 12 may be telescoped into the lower section 202 before the neck 12 is hingedly moved relative to the body 14. In either event, the hinged and telescoping actions of the neck 12, together with the telescoping construction of the body 14, allows the travel guitar 200 to assume a reduced profile according to the present invention.

Figure 15:
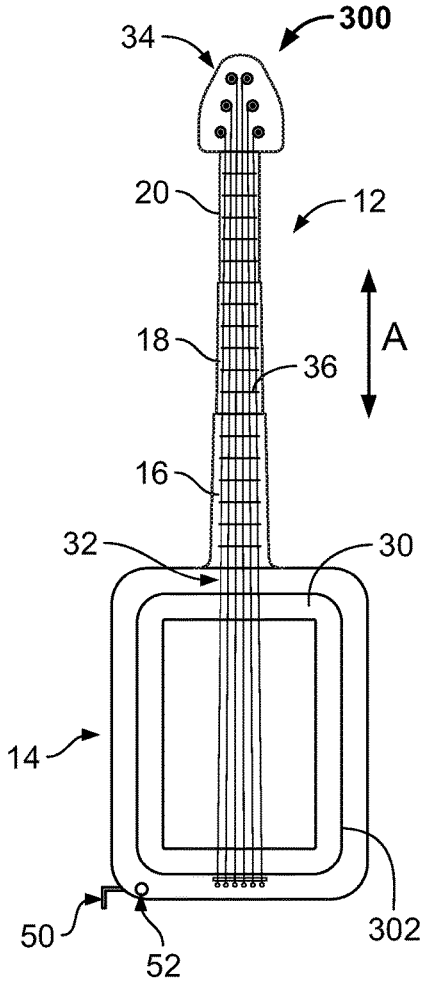
FIG. 15 is a front view of a travel guitar according to one aspect, with the body of fixed or non-telescoping construction and the neck configured to be partially telescoping to assume a reduced profile, and an exemplary tablet computer (e.g. iPad) having one or more applications (apps) for driving the operation, functionality and/or effects associated with the travel guitar.
Figure 16:
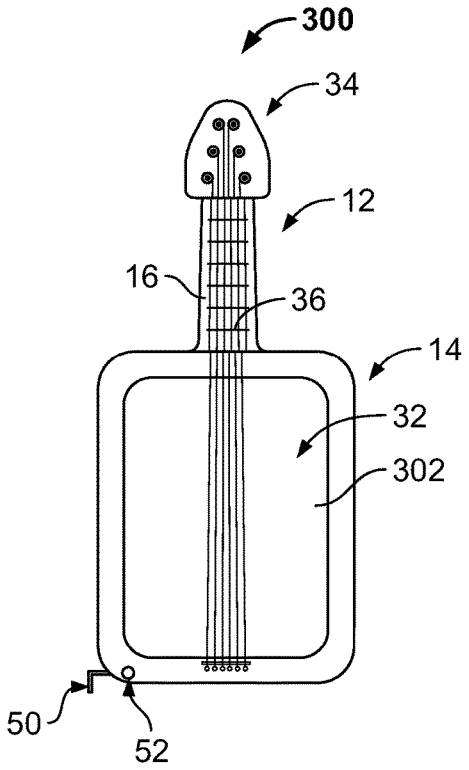
FIG. 16 is a front view of the travel guitar of the type shown in FIG. 15 in a reduced profile due to the partial retraction of the telescoping neck.
Figure 17:
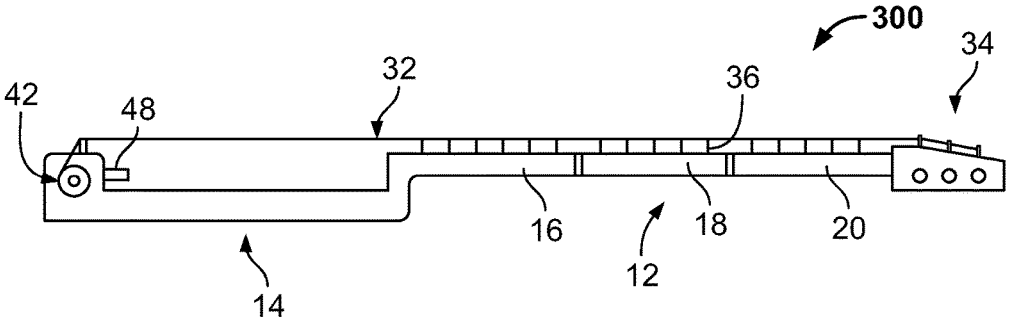
FIGS. 17-18 are side views of the travel guitar of the type shown in FIGS. 15-16 in an expanded profile (FIG. 17) and reduced profile (FIG. 18), respectively, wherein the string assembly includes a string spool disposed within the body to retract or otherwise receive the guitar strings to enable or facilitate configuring the travel guitar into the reduced profile.
Figure 18:
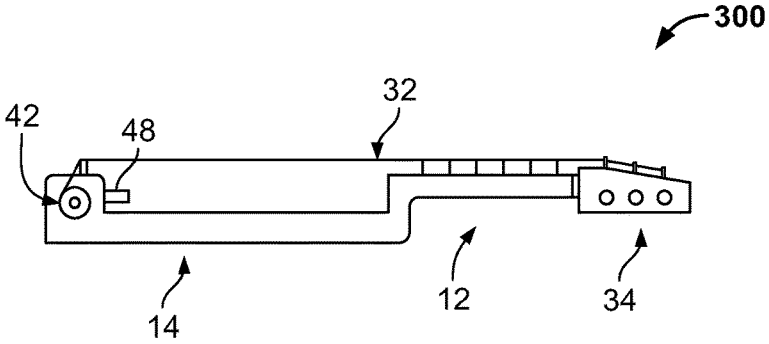

FIG. 15 illustrates a travel guitar 300 according to another aspect. The travel guitar 300 is virtually identical in construction to the travel guitar 10 of FIGS. 1-5, except that the body 14 is of unibody construction and thus is not telescoping. Based on the commonality of construction and components, and for the sake of brevity, only those features and functions varying from the travel guitar 10 of FIGS. 1-5 will be described. As shown in FIG. 16, the body 14 includes a static recess 302 configured, by way of example only, to receive computer tablet 30 as shown in FIG. 15. With reference to FIGS. 15-18, the neck 12 (e.g. middle section 18 and upper section 20) may be moved in a telescoping manner into the lower section 16. The telescoping action of the neck 12 allows the travel guitar 300 to assume a reduced profile according to the present invention.

Figure 19:
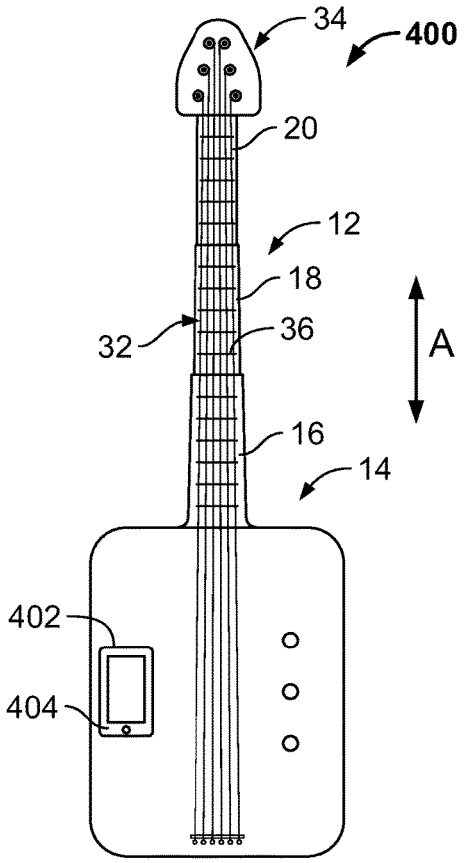
FIG. 19 is a front view of a travel guitar according to one aspect, with the body of fixed or non-telescoping construction and the neck configured to be fully telescoping to assume a reduced profile, and an exemplary smart phone (e.g. iPhone) having one or more applications (apps) for driving the operation, functionality and/or effects associated with the travel guitar.
Figure 20:
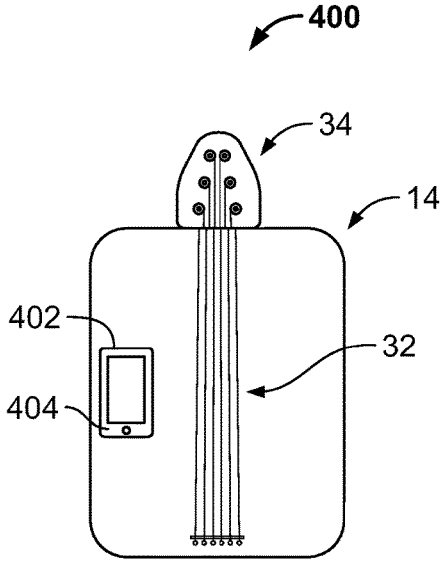
FIG. 20 is a front view of the travel guitar of the type shown in FIG. 19 in a reduced profile due to the full retraction of the telescoping neck.
Figure 21:
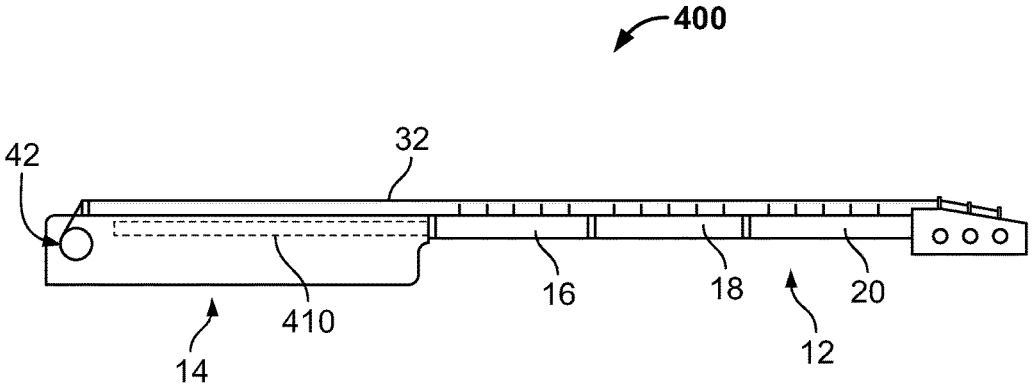
FIGS. 21-22 are side views of the travel guitar of the type shown in FIGS. 19-20 in an expanded profile (FIG. 21) and reduced profile (FIG. 22), respectively, wherein the string assembly includes a string spool disposed within the body to retract or otherwise receive the guitar strings to enable or facilitate configuring the travel guitar into the reduced profile.
Figure 22:
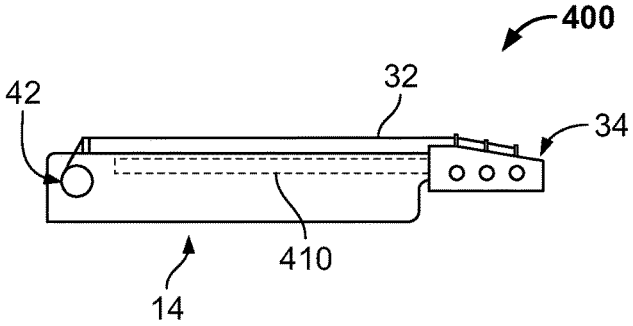

FIG. 19 illustrates a travel guitar 400 according to another aspect. The travel guitar 400 is virtually identical in construction to the travel guitar 300 of FIGS. 15-18, except that the entire neck 12 is telescoping and the body 14 is configured to receive the lower section 16, the middle section 18 and the upper section 20 in a telescoping manner. Based on the commonality of construction and components, and for the sake of brevity, only those features and functions varying from the travel guitar 30 of FIGS. 15-18 will be described. As shown in FIGS. 19-20, the body 14 includes a static recess 402 configured, by way of example only, to receive a smart phone 404 (e.g. iPhone by Apple, Inc.). With reference to FIGS. 19-22, the neck 12 (e.g. lower section 16, middle section 18 and upper section 20) may be moved in a telescoping manner into the base 14. To accommodate this telescoping, the body 14 may be equipped with a recess (shown in dashed lines at 410) having a shape and size sufficient to receive the lower section 16, middle section 18, and upper section 20 as shown generally in FIG. 22. The telescoping action of the neck 12 allows the travel guitar 400 to assume a reduced profile according to the present invention.

Figure 23:
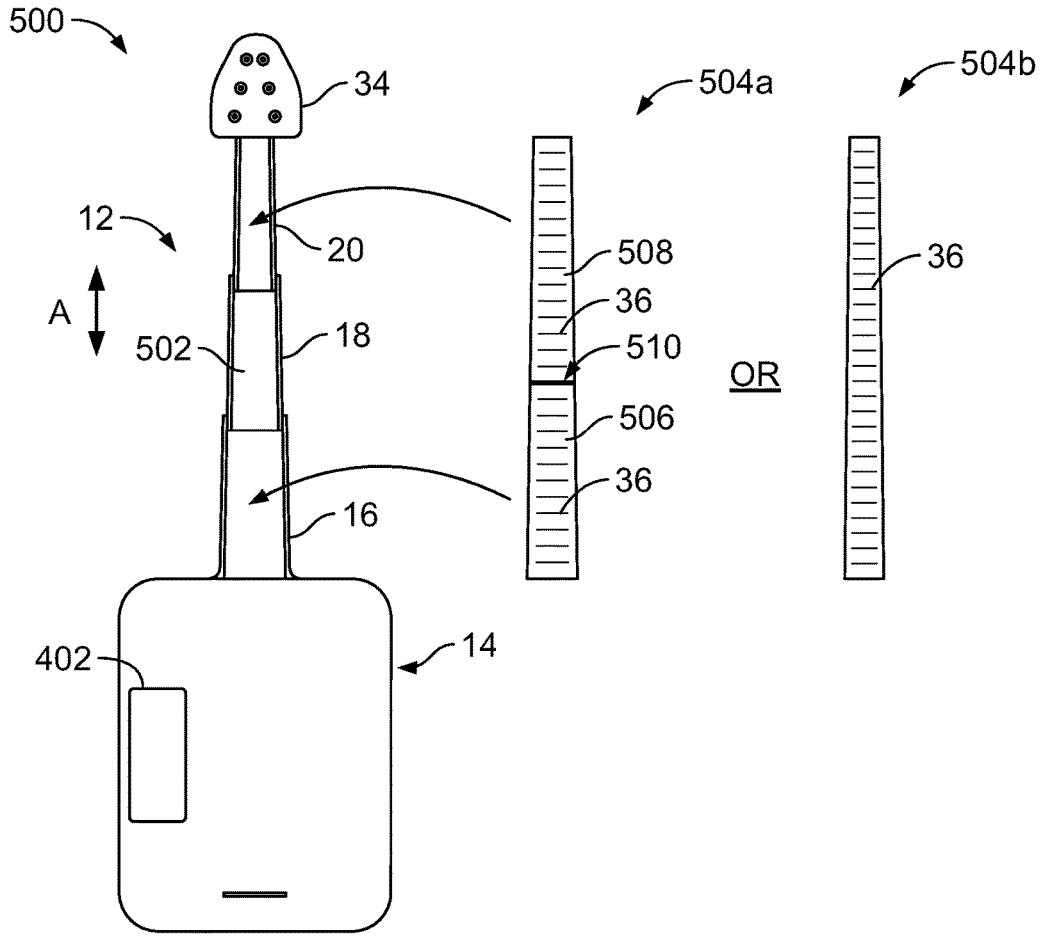
FIG. 23 is a front view of a travel guitar of the type shown in FIGS. 19-22 according to one aspect, with the neck configured to be fully telescoping to assume a reduced profile (FIGS. 20 and 22) or expanded profile (FIGS. 19 and 21) and having a recess upon being fully expanded to receive an insertable fret board of hinged or solid construction.

FIG. 23 illustrates a travel guitar 500 according to another aspect. The travel guitar 500 is virtually identical in construction to the travel guitar 400 of FIGS. 19-22, except that the neck 12 has a fret board recess 502 upon being fully expanded configured to receive an insertable fret board 504. As will be described in detail below, the insertable fret board 504 may take the form of a hinged fret board 504*a* or a solid fret board 504*b*. Based on the commonality of construction and components, and for the sake of brevity, only those features and functions varying from the travel guitar 400 of FIGS. 19-22 will be described.

As shown in FIG. 23, the lower section 16, middle section 18 and upper section 20 of the neck 12 each have an open or hollow construction which collectively defines the fret board recess 502. The fret board recess 502 is configured to receive either fret board 504*a* or 504*b*, from either the top or bottom of the recess 502 as will be described below. The hinged fret board 504*a* includes a lower section 506 hingedly coupled to an upper section 508 via a hinge 510. The solid fret board 504*b* has the same general shape and profile as the hinged fret board 504*a*, except that is of solid construction (i.e. non-hinged or non-telescoping).

Figure 24A:
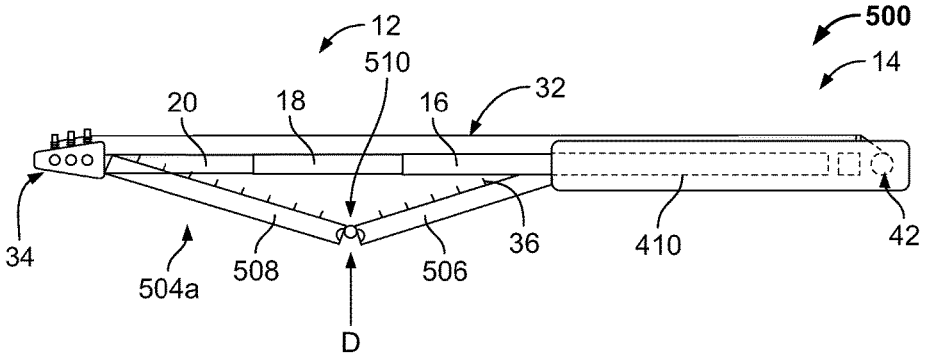
FIGS. 24A-24D are side views of the travel guitar of the type shown in FIG. 23 according to several aspects, illustrating the insertion of a hinged fret board into the recess formed in the telescoping neck (from bottom of neck in FIGS. 24A-24C and from top of neck in FIG. 24D)
Figure 24B:
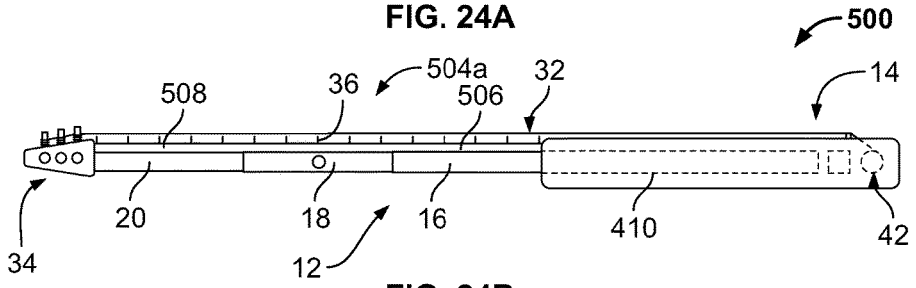
Figure 24C:
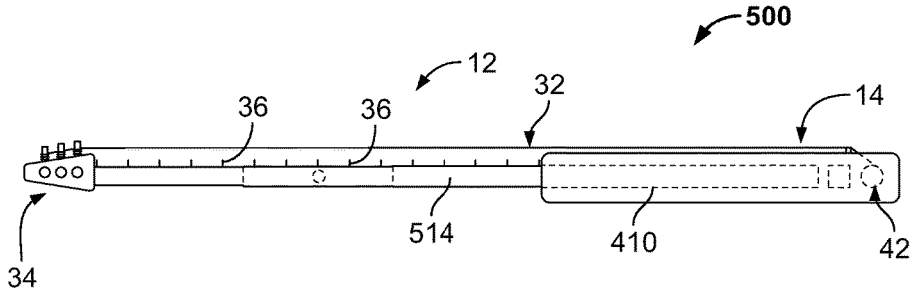

FIGS. 24A-24C illustrate a "bottom loading" technique of inserting the hinged fret board 504*a* into the neck 12 by accessing the recess 502 from the bottom. As shown in FIG. 24A, the hinged fret board 504*a* may be introduced into the recess 502 of the neck 12 such that the lower section 506 and upper section 508 start in an angled relationship with the distal ends in general abutment with the base 14 and head 34, respectively. The medial ends of the lower and upper sections 506, 508 may thereafter be pushed upward to force them into a flat and rigid configuration within the recess 502 in the neck 12 as shown in FIG. 24B. As shown in FIG. 24C, an optional cover 514 may be positioned over the sections 16, 18, 20 of the neck 12 to cover up those telescoping components and/or bolster the structural rigidity of the neck 12. The cover 514 may be generally curved on the lower surface to mimic the shape of the neck of a traditional, non-travel guitar. The cover 514 may be slidably disposed within the base 14 such that it can be quickly and easily deployed from the base 14 after the hinged fret board 504*a* is introduced as shown in FIGS. 24A-24B. Alternatively, the cover 514 may be a free-standing component (i.e. not housed within the base 14) and simply coupled over the sections 16, 18, 20 when desired.

Figure 24D:
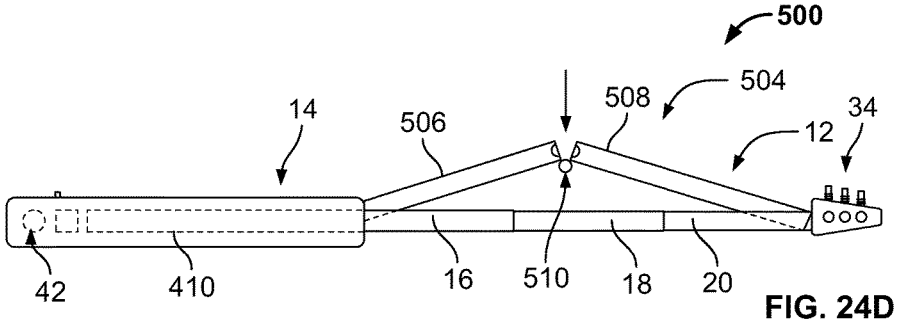

FIGS. 24D illustrates a "top loading" technique of inserting the hinged fret board 504*a* into the neck 12 by accessing the recess 502 from the top. The hinged fret board 504*a* may be introduced into the recess 502 of the neck 12 such that the lower section 506 and upper section 508 start in an angled relationship with the distal ends in general abutment with the base 14 and head 34, respectively. The medial ends of the lower and upper sections 506, 508 may thereafter be pushed downward to force them into a flat and rigid configuration within the recess 502 in the neck 12. This top-loading technique may require the removal of the strings (not shown) or simply that the strings be loose enough to allow the hinged fret board 504*a* to be positioned as shown in FIG. 24D. Other than these distinctions, the features and operation of the hinged fret board 504*a* in the top loading configuration are essentially identical to that described above with respect to the bottom-loading configuration such that their description need not be repeated here.

Figure 24E:
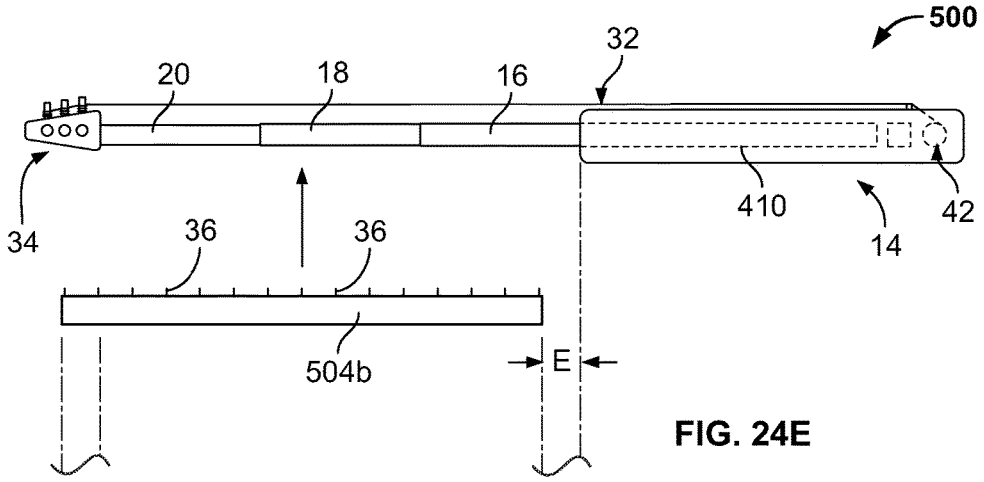
FIGS. 24E-24G are side views of the travel guitar of the type shown in FIG. 23 according to several aspects, illustrating the insertion of a solid fret board into the recess formed in the telescoping neck (from bottom of neck)
Figure 24F:
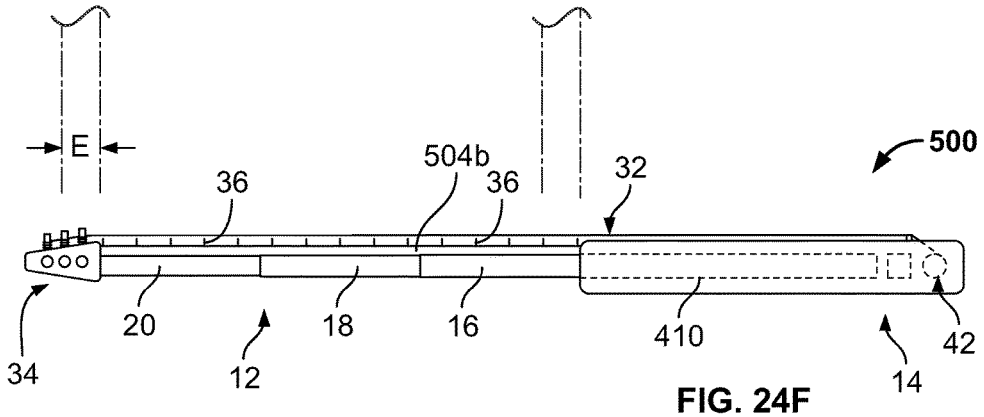
Figure 24G:
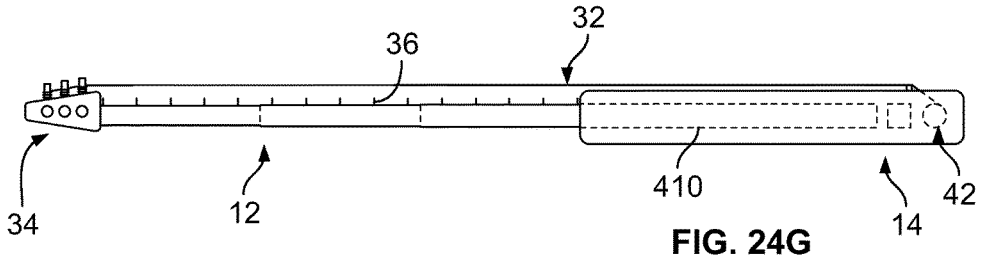

FIGS. 24E-24G illustrate a "bottom loading" technique of inserting the solid fret board 504*b* into the neck 12 by accessing the recess 502 from the bottom. This "bottom loading" technique is virtually identical to that described above with reference to FIGS. 24A-24C, except that the fret board 504*b* is solid and the neck 12 is configured to extend a greater distance from the body 14 to accommodate the solid fret board 504*b*, as will be discussed in more detail below. Based on the commonality of construction and components described above with reference to the "bottom loading" technique of the hinged fret board 504*a*, and for the sake of brevity, only those features and functions varying from that shown in FIGS. 24A-24C will be described.

As shown in FIG. 24E, neck sections 16, 18, 20 may be moved farther away from the body 14 than shown in FIG. 24A. This may be accomplished by providing one or more of the neck sections 16, 18, 20 having spring-loaded features to allow the neck 12 to be over-extended relative to the body 14, for example, by a distance E, sufficient to allow the solid fret board 504*b* to be introduced as shown in FIG. 24E. Once introduced into the recess 502, the neck 12 may be allowed to retract towards the base 14 such that the length of the neck 12 shortens relative to the base 14 by the distance E as shown in FIG. 24F. Depending upon the bias of the spring-loaded features, the neck 12 may or may not require to be locked in that position. It will be appreciated that, although spring-loaded features are but one way to adjust the neck 12, it may be done manually with no assistance of any spring loading features within the neck 12 and/or body 14. It will also be appreciated that, although the spring-loaded features are described with reference to the solid fret board 504*b*, this same functionality may be employed with the travel guitar 500 as shown in FIGS. 24A-24D without departing from the scope of the invention. Lastly, the optional cover 514 may be employed in the same manner as described above with reference to FIGS. 24A-D.

Figure 25:
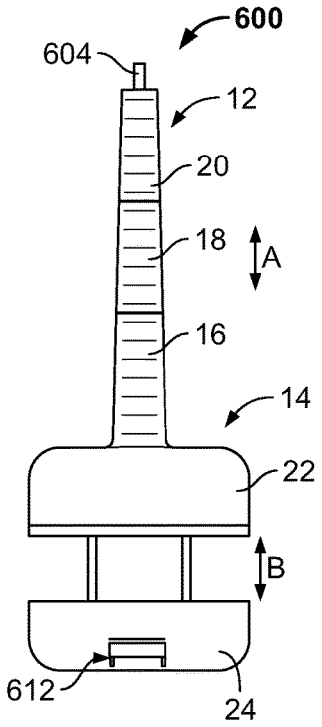
FIG. 25 is a front view of a travel guitar according to one aspect, wherein the neck is configured to receive a detachable head (FIG. 26) and the base is configured to receive a detachable string spool assembly (FIG. 26)
Figure 26:
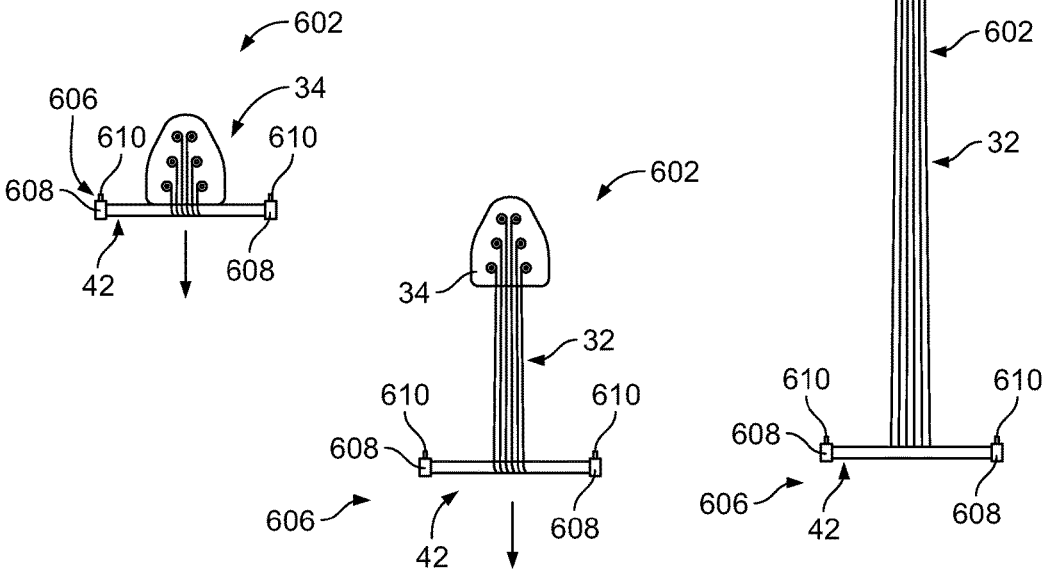
FIG. 26 is a front view of a detachable string assembly according to one aspect, including a detachable head to be coupled to the neck of FIG. 25 and a detachable string spool assembly to be coupled to the base of FIG. 25.

FIGS. 25-26 illustrate a travel guitar 600 according to a still further aspect. The travel guitar 600 is virtually identical in construction to the travel guitar 10 of FIGS. 1-5, except for the provision of a detachable string assembly 602 (FIG. 26) as will be described below. Based on the commonality of construction and components, and for the sake of brevity, only those features and functions varying from the travel guitar 10 of FIGS. 1-5 will be described. As shown in FIG. 26, the detachable string assembly 602 includes the head 34, the string spool 42 and the strings 32, wherein the string spool 42 forms part of a string spool assembly 606 including end portions 608 disposed on either end of the string spool 42 which are fixedly coupled together via a cross bar (not shown) disposed within the string spool 42. The end portions 608 may be equipped with rotation levers 610, the function of which will be described in greater detail below.

With reference to FIG. 25, the neck 12 includes a coupling arm 604 extending from the upper section 20 dimensioned to slide into a corresponding recess (not shown) formed within the head 34 of the detachable string assembly 602. The lower body unit 24 includes a recess 612 dimensioned to receive the string spool assembly 606, as will be described in greater detail below.

Figure 27:
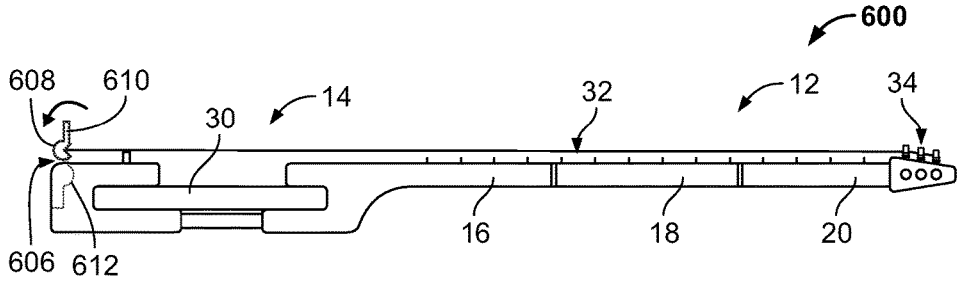
FIGS. 27-28 are side views illustrating one manner of attaching the detachable string assembly of the type shown in FIG. 26 to a travel guitar of the type shown in FIG. 25 according to one aspect, involving: (a) attaching the detachable head to the neck; (b) engaging the string spool assembly into the base (FIG. 27); and (c) locking the string spool assembly into the base (FIG. 28)
Figure 28:
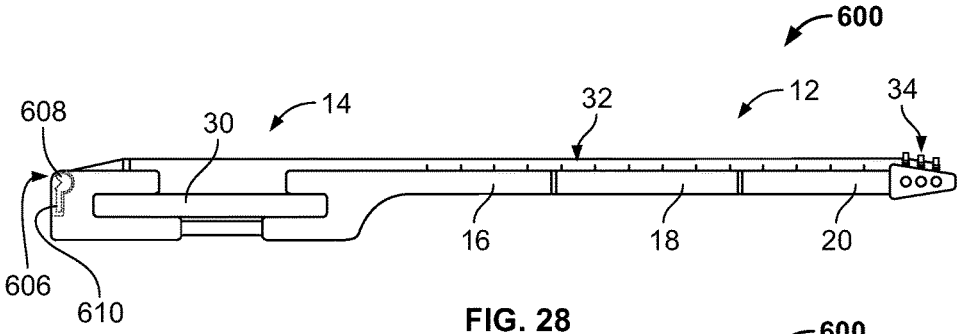

FIGS. 27-28 illustrate one manner of attaching the string assembly 602 to the travel guitar 600 according to one aspect. In particular, the head 34 is first coupled to the neck 12 by disposing the coupling arm 604 into the recess (not shown) formed within the head 34. The string spool assembly 606 may then be moved towards the lower base unit 24 so the string 32 unspools from the string spool 42 as shown generally in FIG. 26. This unspooling continues until the string spool assembly 606 is positioned such that the end portions 608 can be at least partially engaged within the recess 612 as shown in FIG. 27. At this point, the rotation levers 610 may be rotated to fully seat the string spool 42 within the recess 612 as shown in FIG. 28. Preferably, the length of the strings 32 are such that, when the string spool 42 is fully seated in the recess 612 as shown in FIG. 28, the strings 32 are generally taut such that it will only take a minimal amount of tuning to ready the strings 32 for use.

Figure 29:
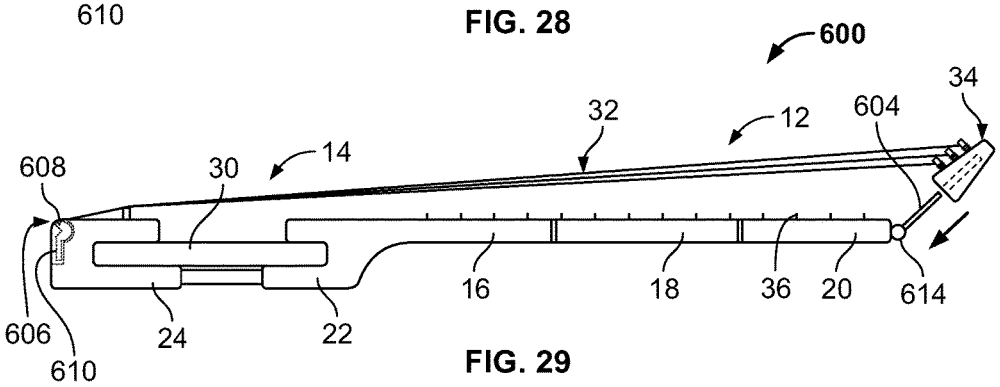
FIGS. 29-30 are side views illustrating another manner of attaching the string assembly of the type shown in FIG. 26 to a travel guitar of the type shown in FIG. 25 according to one aspect, involving: (a) engaging the string spool assembly to the base; (b) attaching the detachable head to an angled and hinged strut coupled to the neck (FIG. 29); and (c) locking the string assembly by: (i) rotating the head as shown in FIG. 30 and (ii) locking the string spool assembly into the base (before, during or after rotating the head as shown in FIG. 30)
Figure 30:
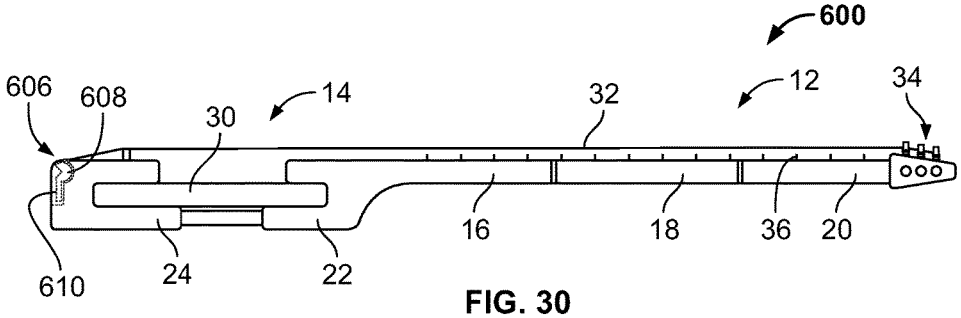

FIGS. 29-30 illustrate another manner of attaching the string assembly 602 to the travel guitar 600 according to one aspect. In particular, the string spool assembly 606 is engaged and locked to the lower base unit 24 as a first step. The head 34 may then be moved towards the arm member 604 extending from the neck 12 so the string 32 unspools from the string spool 42. This unspooling continues until the head 34 is coupled to the arm member 604 as shown in FIG. 29. In one aspect, the arm member 604 may be angled and hinged to the upper section 20 of the neck 12 via a hinge 614 as shown in FIG. 29. At this point, the head 34 may be rotated about the hinge 614 such that the head 34 is fully rotated and locked in the position as shown in FIG. 30. Preferably, the length of the strings 32 are such that, when the head 34 is fully rotated and locked in the position as shown in FIG. 30, the strings 32 are generally taut such that it will only take a minimal amount of tuning to ready the strings 32 for use.

Figure 31:
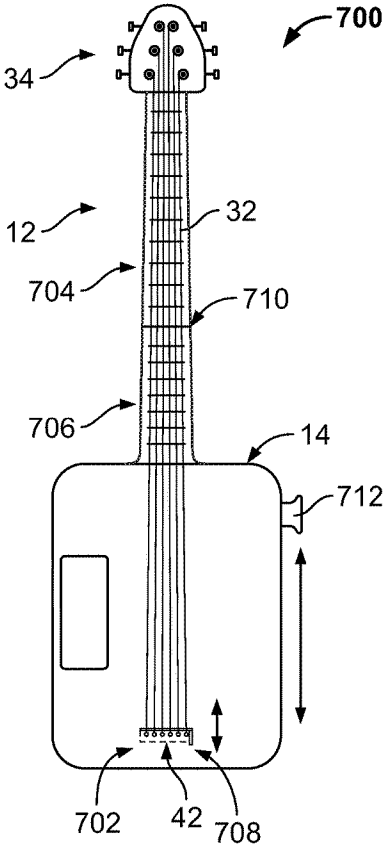
FIG. 31 is a front view of a travel guitar according to one aspect, with the neck configured to be foldable such that an upper portion of the neck folds away from a lower portion, and an exemplary smart phone (e.g. iPhone) having one or more applications (apps) for driving the operation, functionality and/or effects associated with the travel guitar.

FIG. 31 illustrates a travel guitar 700 of a still further aspect of the present invention. The travel guitar 700 is configured such that the bridge assembly 702 (and/or string spool 42, if implemented) can be translated longitudinally towards the head 34 to allow sufficient de-tensioning of the guitar strings 32 to enable the upper portion 704 of the neck 12 to be folded away from the lower portion 706 of the neck 12 about a hinge 710 to assume a reduced profile (see FIGS. 32-34). In one aspect, the bridge assembly 702 includes a handle member 708 capable of being rotated or otherwise actuated to allow or force the bridge assembly 702 to move towards the head 34, as illustrated by distance F in FIGS. 32-34. Although not shown, it will be appreciated that the translation of the bridge assembly 702 and/or the spool assembly 42 may be accomplished through the use of servo motors disposed with the body 14 which, when actuated, will move the bridge assembly 702 and/or spool assembly 42 either towards or away from the head 14 for the purpose of detensioning or tensioning, respectively, the strings 32.

Figure 32:
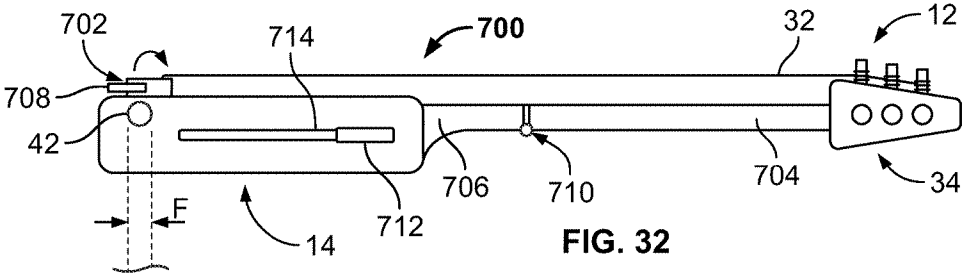
FIGS. 32-34 are side views of the travel guitar of the type shown in FIG. 31, illustrating the manner of folding the upper portion of the neck away from the lower portion of the neck as enabled via the longitudinal translation of the bridge assembly and/or spool assembly.

When it is desired to deploy the travel guitar 700 for playing, the upper portion 704 of the neck 12 may be unfolded back into alignment with the lower portion 706 of the neck 12, and the bridge assembly 702 (and/or spool assembly 42, if implemented) translated longitudinally away from the head 34 and locked in position to allow the guitar 700 to be tuned for playing. As described above, this may be accomplished manually through the use of the handle member 708 to bring the bridge assembly 702 and/or spool assembly 42 in its original position (FIGS. 31 and 32) or, alternatively, through the use of servo motors disposed with the body 14 which, when actuated, will move the bridge assembly 702 and/or spool assembly 42 to its original position (FIGS. 31 and 32).

In either embodiment (manual or automated), the physical movement of the bridge assembly 702 and/or spool assembly 42 may be effectuated by coupling the bridge assembly 702 and/or spool assembly 42 to slidable rail(s) within the body 14 and/or slidable plate(s) on the surface of the body 14 of the travel guitar 700. In one aspect, one or more pick-ups may be translated longitudinally with the bridge assembly 702 and/or spool assembly 42.

Figure 33:
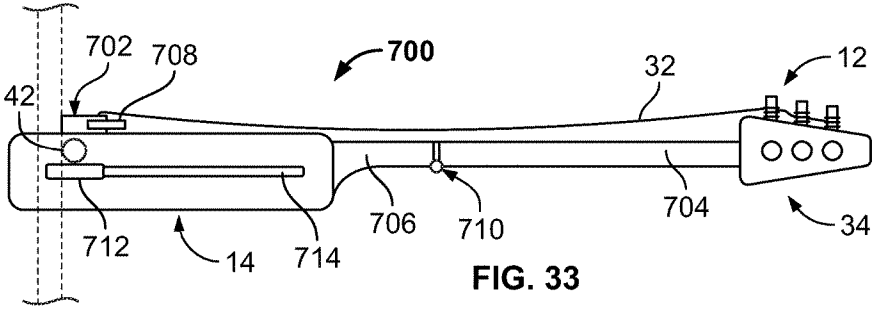
Figure 34:
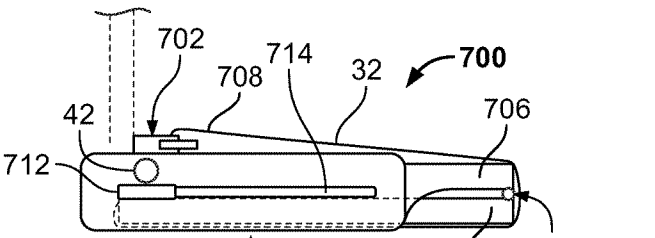

In another aspect, the travel guitar 700 may be configured with one or more translating truss rods housed within at least a portion of the neck 12 to bolster its strength and rigidity for more accurate and prolonged tuning and fret alignment. As shown in FIGS. 31-34, a handle member 712 is coupled to the body 14 and capable of translating along a track 714 from a position closest the head 34 (FIG. 31-32) to a position farthest away from the head 34 (FIG. 33-34). As will be described in detail below, the handle member 712 is coupled to one or more unitary truss rods and/or hinged truss rods for the purpose of selectively locking and unlocking the upper neck portion 704 relative to the lower neck portion 706 depending on the location of the handle member 712 (e.g. locked in FIGS. 31-32 and unlocked in FIGS. 33-34).

Figure 36:
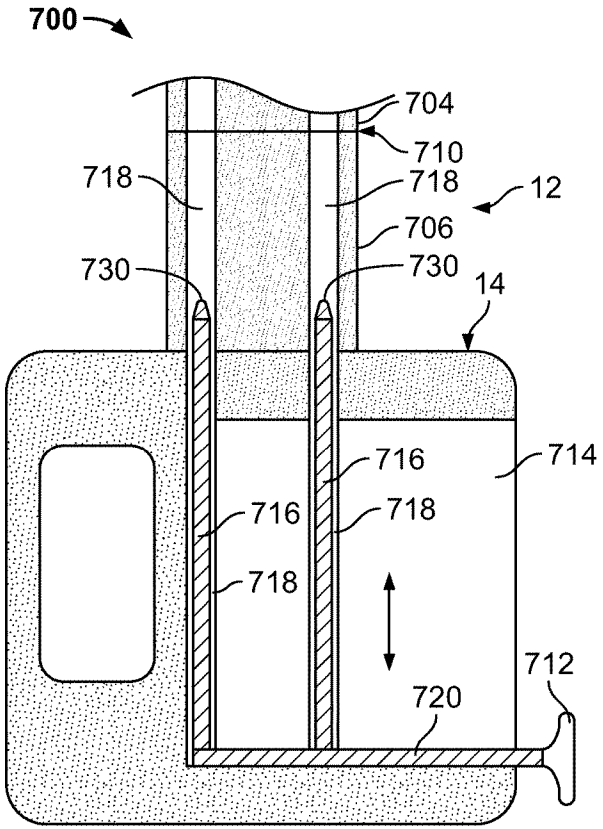
FIG. 36 is a top view of a section of a travel guitar of the type shown in FIG. 31, in partial cross section, illustrating a pair of translating truss rods of unitary construction retracted within recesses from across a joint in the neck for the purpose of unlocking and folding to the upper and lower neck sections.
Figure 35:
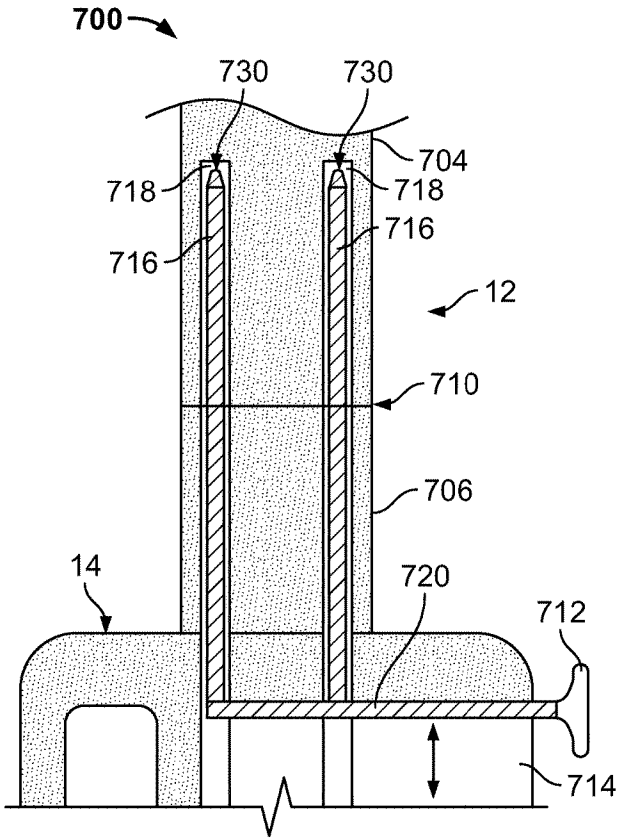
FIG. 35 is a top view of a section of a travel guitar of the type shown in FIG. 31, in partial cross section, illustrating a pair of translating truss rods of unitary construction positioned within recesses across a joint in the neck for the purpose of locking and providing rigidity to the upper and lower neck sections.

In one aspect shown in FIGS. 35-36, two translating truss rods 716 are provided, each of which is a unitary structure capable of being translated longitudinally within one or more passageways or recesses 718 formed in the upper portion 714 and/or lower portion 706. The translation takes place between a locked position shown in FIG. 35 and an unlocked position shown in FIG. 36, based on the selective movement by a user of the handle member 712 which is coupled to the truss rods 716 via a connecting rod 720 which traverses along track or groove 714 in the body 24. In the locked position (FIG. 35), each unitary truss rod 716 is disposed at least partially within both the lower portion 706 and upper portion 704 of the neck 12, which locks the upper neck portion 704 in alignment with the lower neck portion 706. In the unlocked position (FIG. 36), each unitary truss rod 716 is disposed within the lower neck portion 706 and/or body portion 14, just as long as its removed from the upper neck portion 704 a sufficient distance below the hinge 710 such that the upper neck portion 704 may be folded into a reduced profile as shown in FIG. 34.

Figure 38:
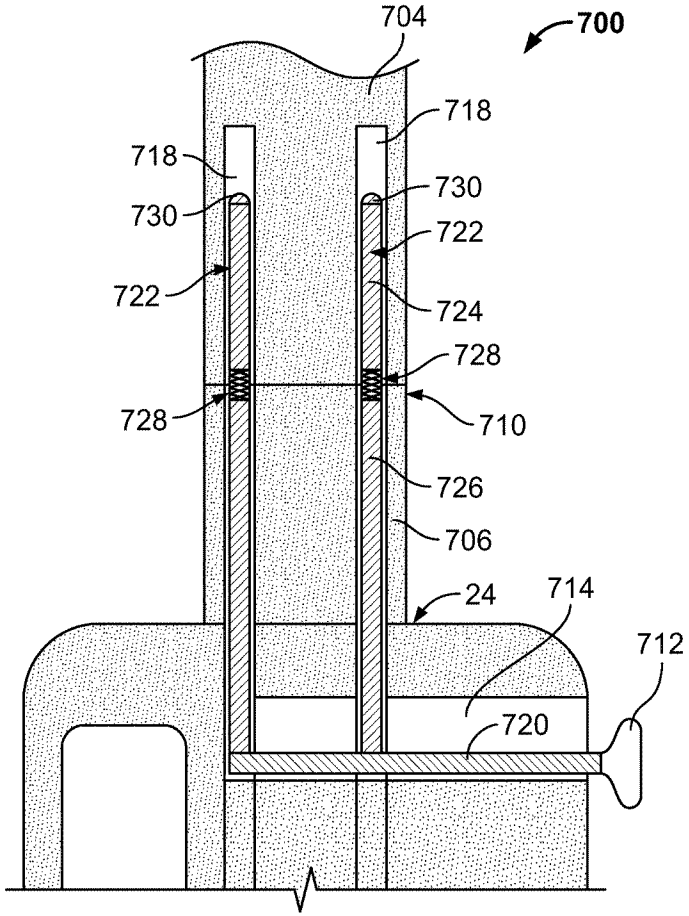
FIG. 38 is a top view of a section of a travel guitar of the type shown in FIG. 31, in partial cross section, illustrating a pair of translating truss rods of hinged construction positioned within recesses such that the hinge of each truss rod is aligned with the joint in the neck for the purpose of unlocking and folding to the upper and lower neck sections.
Figure 37:
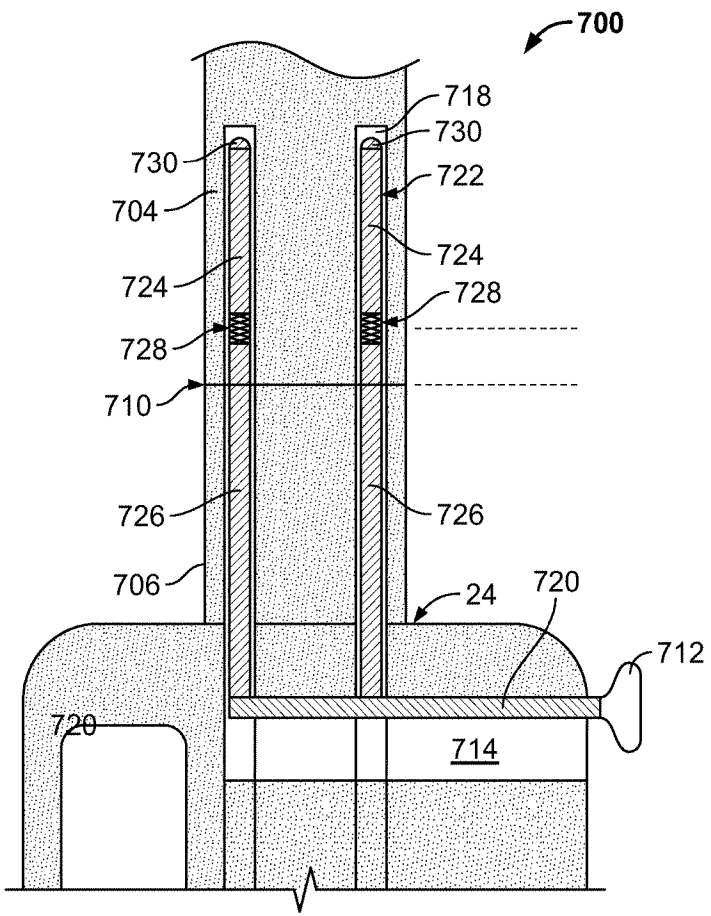
FIG. 37 is a top view of a section of a travel guitar of the type shown in FIG. 31, in partial cross section, illustrating a pair of translating truss rods of hinged construction positioned within recesses such that the hinge of each truss rod is not aligned with the joint in the neck for the purpose of locking and providing rigidity to the upper and lower neck sections.
Figure 39:
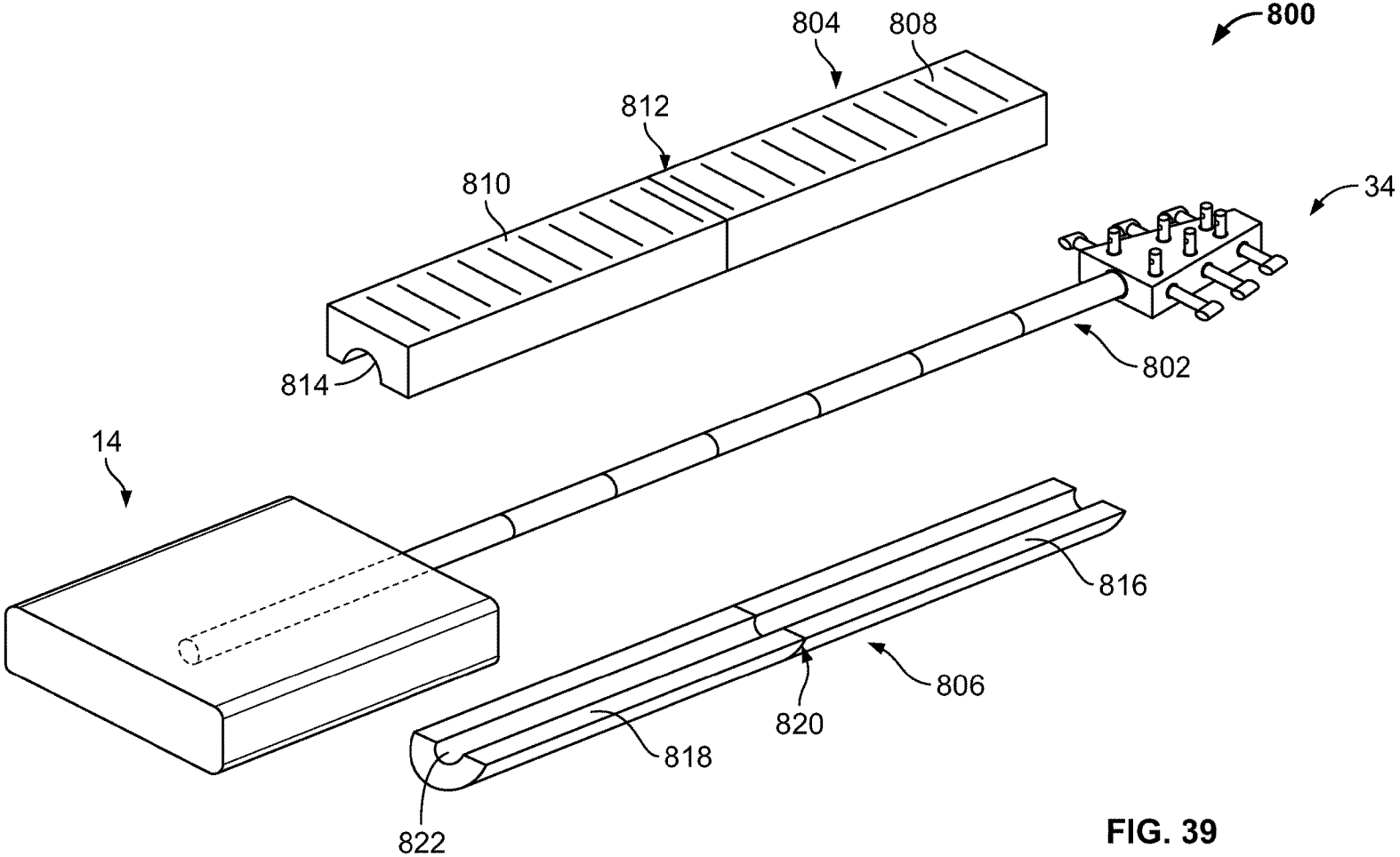
FIG. 39 is a perspective and partially exploded view of a travel guitar according to an aspect, wherein the neck includes a telescoping cylinder, along with a foldable fret board and foldable neck bottom which collectively enclose the telescoping cylinder when the guitar is deployed for use and which fold onto and/or within a portion of the body when the guitar is in a reduced profile.

In one aspect shown in FIGS. 37-38, two translating truss rods 722, each of which is a hinged structure capable of being translated longitudinally within one or more passageways or recesses 718 formed in the upper portion 704 and/or lower portion 706 between a locked position shown in FIG. 38 and an unlocked position shown in FIG. 39. Each truss rod 722 is constructed from a rigid upper portion 724 hingedly coupled to a rigid lower portion 726 coupled together by a hinge 728.

In the locked position (FIG. 37), the upper portion 724 of each hinged truss rod 722 is disposed at least partially within the upper portion 704 of the neck 12, the lower portion 726 of each hinged truss rod 722 is disposed at least partially within the lower portion 706 of the neck 12, and the hinge or hinged section 728 is disposed within either the upper portion 704 or lower portion 706 of the neck 12. By disposing the hinged portion 728 of the truss rod 722 in the upper portion 704 or lower portion 706 of the neck 12, the truss rod 722 can no longer rotate about hinge 728 and thus has strength and rigidity characteristics similar to that of a unitary truss rod 716.

In the unlocked position (FIG. 38), the upper portion 724 of each hinged truss rod 722 is disposed at least partially within the upper portion 704 of the neck 12, the lower portion 726 of each hinged truss rod 722 is disposed at least partially within the lower portion 706 of the neck 12, and the hinge or hinged section 728 is disposed at the approximate junction or joint 710 between the upper portion 704 and lower portion 706 of the neck. By disposing the hinge or hinged section 728 of the truss rod 722 at the approximate junction or joint 710 between the upper section 704 and lower section 706 of the neck 12, the upper section 704 of the neck 12 may then be folded to assume a reduced profile (FIG. 34).

Each truss rod (unitary 716 or hinged 722) may be translated with or independent of the translating bridge assembly 702 and/or spool assembly 42. If translated with the bridge assembly 702 and/or spool assembly 42, each unitary truss rod 716 will be moved in the opposite direction as the bridge assembly 702 and/or spool assembly 42, while each hinged truss rod 722 may be translated in the either the same or opposite direction as the bridge assembly 702 and/or spool assembly 42. The translation of each truss rod (unitary 716 or hinged 722) may occur simultaneous with the translation of the bridge assembly 702 and/or spool assembly 42, or slightly staggered in time.

Staggering translation to assume a reduced profile first involves translating the bridge assembly 702 and/or spool assembly 42 towards the neck 12 (FIG. 32 to FIG. 33) in order to reduce the tension of the guitar strings 32, followed by translating each truss rod 716/722 into the unlocked position (FIG. 32 to FIG. 33) such that the upper neck portion 704 may be folded towards the lower neck portion 706. Staggering translation during deployment of the travel guitar 700 first involves translating each truss rod 716/722 into the locked position (FIG. 33 to FIG. 32) after the upper neck portion 704 and lower neck portion 706 have been brought into alignment, followed by translating the bridge assembly 702 and/or spool assembly 42 away from the neck 12 (FIG. 33 to FIG. 32) in order to increase the tension of the guitar strings 32 in preparation for tuning.

Each truss rod 716/722 may be constructed from any number of materials having properties sufficient to bolster the strength and rigidity of the neck 12 of the travel guitar 700, including but not limited to metal, carbon fiber, etc. . . . Each truss rod 716/722 may be manufactured having any number of solid cross-sectional shapes (e.g. circular, oval, triangular, etc. . . . ) and/or non-solid cross-sectional shapes (e.g. generally crescent-shaped, generally V-shaped, generally U-shaped, etc. . . . ). If constructed having a non-solid cross-sectional shape, the "open" side of the truss rod 716/722 may be disposed within the neck 12 so as to face generally towards the underside of the neck (versus towards the fret board). This configuration will provide the greatest strength and rigidity for the truss rod 716/722 to resist the tendency of the neck 12 to bend under the tension of the guitar strings 32 after they have been tuned.

With reference to FIGS. 35-38, each truss rod 716/722 should preferably be equipped with a leading end 730 which is tapered or otherwise configured to facilitate introduction into the recess 718 of the upper section 704 of the neck 12 during the process of deploying the travel guitar 700 for use. By providing such a tapered leading end 730, the upper neck portion 704 and lower neck portion 706 need not be perfectly aligned in order to begin to receive the truss rods 716/722. Rather, the tapered leading end 730 will be able to enter a non-perfectly aligned recess 718 of the upper neck portion 704. Once in this initial position, the truss rod 716/722 may thereafter be advanced more fully into the recesses 718, which will bring the recesses 718 (and thus upper section 704 and lower section 706) into co-alignment.

It should be noted that the recesses 718 are shown having a larger diameter than the truss rod 716/722 in FIGS. 35-37 solely for the sake of delineating between the two structures in the interest of clarity. It will be appreciated, however, that the diameter of the recesses 718 and truss rods 716/722 may be much closer so as to ensure a snug fit between the two during full deployment, akin to that shown in FIG. 38.

FIG. 39 illustrates (in an exploded view) a travel guitar 800 according to yet another aspect, wherein the neck 12 includes a telescoping cylinder 802, along with a foldable fret board 804 and foldable neck bottom 806 which collectively enclose the telescoping cylinder 802 when the guitar 800 is deployed for use and which fold onto and/or within a portion of the body 14 when the guitar 800 is in a reduced profile. The telescoping cylinder 802 extends from the body 14 to the head 34 and, as will be described in more detail below, is capable of positioning the head 34 in a fully extended position (shown in FIG. 39) to a fully retracted position adjacent to the body 14 (shown in FIG. 43). The function of the foldable neck bottom 806 is to create a smooth surface on the underside of the neck 12 to create the same feel as the underside of a traditional (i.e. non-telescoping, non-folding) guitar neck.

The foldable fret board 804 includes an upper section 808 and a lower section 810 which are hingedly coupled together at a joint 812. Although not shown based on the exploded view of FIG. 39, the end of the upper section 808 opposite the joint 812 is hingedly coupled to the head 34 (or the section of the telescoping cylinder 802 adjacent to the head 34), while the end of the lower section 810 opposite the joint 812 is hingedly coupled to the base 14. The underside of the foldable fret board 804 includes a semi-circular recess 814 dimensioned to receive the telescoping cylinder 802 when the travel guitar 800 is fully deployed for use. Although not shown, the hinges contemplated for use between the body 14 and lower fret board section 810, between the lower and upper fret board sections 810, 808, and between the upper fret board section 808 and the head 34 may comprise any number of suitable hinges which allow for the various types of folding described below with reference to FIGS. 40-43.

The foldable neck bottom 806 includes an upper section 816 and a lower section 818 which are hingedly coupled together at a joint 820. Although not shown based on the exploded view of FIG. 39, the end of the upper section 816 opposite the joint 820 is hingedly coupled to the head 34 (or the section of the telescoping cylinder 802 adjacent to the head 34), while the end of the lower section 818 opposite the joint 820 is hingedly coupled to the base 14. The foldable neck bottom 806 includes a semi-circular recess 822 dimensioned to receive the telescoping cylinder 802 when the travel guitar 800 is fully deployed for use. Although not shown, the hinges contemplated for use between the body 14 and lower section 818, between the lower and upper sections 816, 818, and between the upper section 816 and the head 34 may comprise any number of suitable hinges which allow for the various types of folding described below with reference to FIGS. 40-43.

Figure 40:
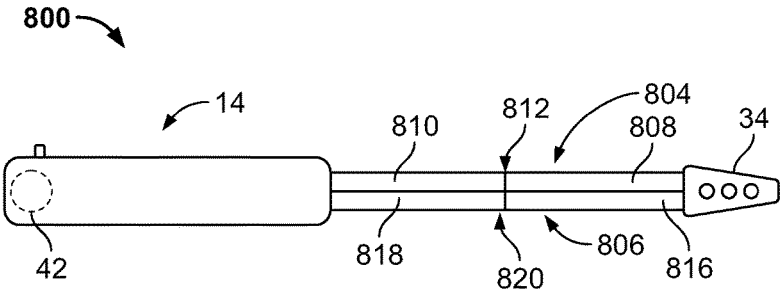
FIG. 40-43 are side views of the travel guitar of the type shown in FIG. 39, illustrating the manner of configuring the foldable fret board and foldable neck bottom into a reduced profile as the head is moved towards the body by operation of the telescoping cylinder.

FIGS. 40-43 illustrate the manner of configuring the foldable fret board 804 and foldable neck bottom 806 into a reduced profile as the head 34 is moved towards the body 14 by operation of the telescoping cylinder 802. FIG. 40 shows the travel guitar 800 in a fully deployed configuration with the foldable fret board 804 and foldable neck bottom 806 extending in alignment between the body 14 and head 34. In this configuration, the foldable fret board 804 and foldable neck bottom 806 are abutting with the upper sections 808, 816 and lower sections 810, 818 positioned generally adjacent to and flush with one another. One or more locking mechanisms (not shown) may be provided to maintain the telescoping cylinder 802, the foldable fret board 804 and/or the foldable neck bottom 806 in the fully deployed configuration as shown in FIG. 40.

Figure 41:
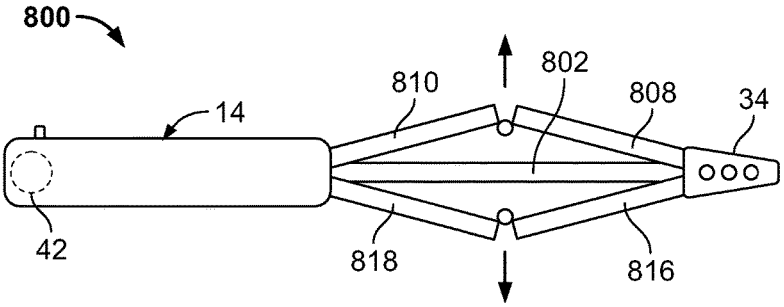
Figure 42:
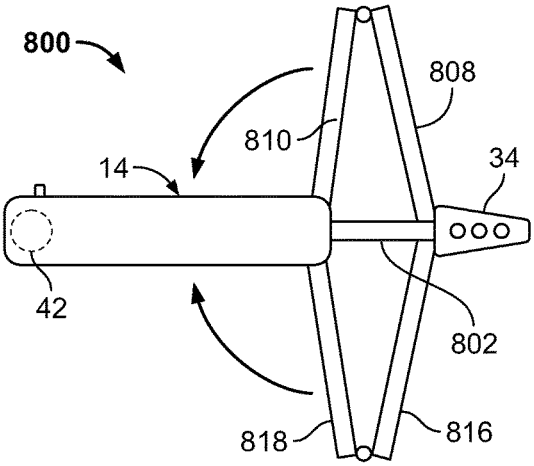
Figure 43:
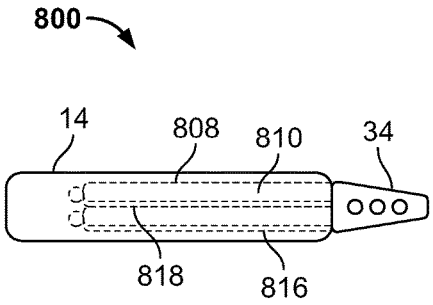

FIGS. 41-43 illustrate the travel guitar 800 during the process of configuring it into a reduced profile. This involves shortening the telescoping cylinder 802 while moving the middle of the foldable fret board 804 away from the middle of the foldable neck bottom 806 (FIG. 41) until the foldable fret board 804 folds towards the upper surface of the body 14 and the foldable neck bottom 806 folds towards the lower surface of the body 14 (FIG. 42). This continues until the upper section 808 and lower section 810 of the foldable fret board 804 are positioned within a portion of the body 14 and the upper section 816 and lower section 818 of the foldable neck bottom 806 are positioned within a portion of the body 14 (FIG. 43). Although not shown, it will be appreciated that some or all of the foldable fret board 804 and/or foldable neck bottom 806 may simply fold on top of the body 14, as opposed to being partially or fully housed within a cavity or recess in the body 14 as shown in FIG. 43.

While strings are not shown in FIGS. 39-43 for the sake of brevity, it will be understood that the travel guitar 800 may employ any of the string-related features previously described with respect to any of the previous figures, including (by way of example only) the string spool 42, translating bridge assembly, removable string assemblies, etc. . . .

Figure 44:
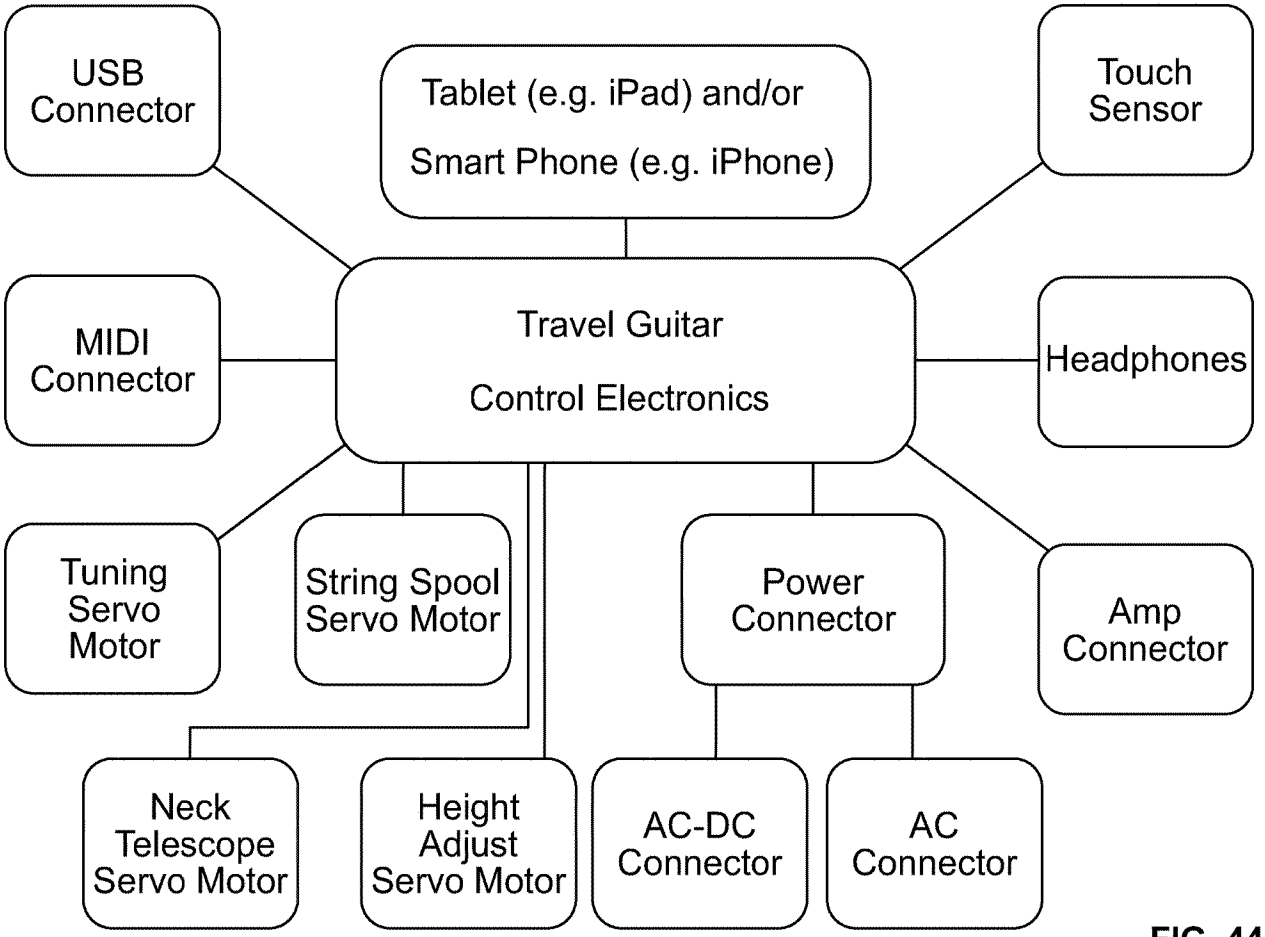
FIG. 44 is a diagrammatic view of exemplary electrical components associated with the travel guitar according to one aspect.

FIG. 44 is a diagram illustrating the electrical components associated with any of the travel guitars described herein, according to one aspect. The tablet computer and/or smart phone described herein may be coupled to the control electronics (e.g. via a 32-pin Apple connector if tablet is an iPad and/or smart phone is an iPhone) to electrically connect any of the components forming the control electronics or otherwise coupled to the control electronics.

The on-board electronics and/or electronics or software on the tablet and/or smart phone may operate any of the servo motors contemplated as part of the travel guitar of the present invention, including but not limited to servo motors for telescoping the neck and/or body, for tuning the travel guitar, for spooling the guitar string, for adjusting the height of the individual frets on the fret board and/or the bridge on the body and/or the nut on the head of the neck (such height adjustment of the frets, bridge and/or nut may be performed to help tune the travel guitar and/or adjust the action of the strings according to user preference), as well as adjusting the location of the translating bridge assembly and/or translating truss rods according to certain aspects.

A power connector is preferably provided so that a suitable AC/DC power converter can be connected an AC power source (e.g. wall outlet) to power the electrical components of the travel guitar. Any number of connectors may be provided (e.g. USB, Firewire, etc. . . . ) so that the tablet computer and/or smart phone can be connected to an external computer, video game console, or the like to either interact with such or be powered therefrom. A MIDI connector is preferably provided so that the travel guitar can be connected to any MIDI compatible equipment. Connectors may also be provided for headphones (and/or external speakers), as well as for a guitar amplifier. Any such electrical connectors can be utilized in any combination and/or any other suitable type of electrical connection can additionally be provided.

The memory and/or processor of the tablet computer and/or smart phone may be provided with suitable software to graphically display any number of different graphics or images on the touch screen, e.g. a tuning device such as found with the PitchBot app, animation or graphics that change in response to the tempo, beat, volume, strumming pattern, etc. . . . The software on the computer tablet and/or smart phone can also display a whammy bar, volume control knob or any other desired element on the touch screen to visually simulate a traditional (non-travel) guitar.

The software can enable the travel guitar to be used as a music synthesizer and provide a musical output signal that is sent to a tablet computer speaker, an external speaker or headphones, an external amplifier, an external MIDI capable component, an external computer, and/or any other suitable device. The software can have a midi output that can be used to create music and/or can permit playing along with music files located on the tablet computer and/or smart phone. The software application may also upload files to video games such as, for example Guitar Hero, Second Life, etc. It is also noted that the software can also enable the travel guitar to be used in any other desired manner.

Any of the features or attributes of the above the above described embodiments and variations can be used in combination with any of the other features and attributes of the above described embodiments and variations as desired.

The travel guitars set forth herein overcome or at least improve upon the disadvantages of the prior art by providing a reduced profile for ease of travel and predictable tuning and quality guitar play. Moreover, by using commercially available a computer tablet and/or smart phone, the effective cost of the travel guitar is reduced to the user because those devices are available for other uses.

From the foregoing disclosure and detailed description of certain preferred embodiments, it is also apparent that various modifications, additions and other alternative embodiments are possible without departing from the true scope and spirit. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. A travel guitar, comprising:

a lower neck portion moveably coupled to an upper neck portion, said lower and upper neck portions each including a generally flat upper surface with a plurality of spaced apart frets disposed along at least part of said upper surface, said lower and upper neck portions each including an elongated recess dimensioned to be in linear alignment when said lower and upper neck portions are in linear alignment;

a translating bridge assembly configured to be selectively moved in a linear manner relative to said lower and upper neck portions, said translating bridge assembly configured to secure a first end of a set of musical strings that extend over said lower and upper neck portions, wherein linear movement of said translating bridge assembly in a first direction relative to said lower and upper neck portions increases tension applied to said musical strings to create a tensioned string state, and wherein linear movement of said translating bridge assembly in a second direction relative to said lower and upper neck portions decreases tension applied to said musical strings to create a detensioned string state; and a translating truss assembly dimensioned to be selectively moved in a linear manner within said recesses of said lower and upper neck portions when said lower and upper neck portions are in linear alignment, said translating truss assembly including a hinge disposed between a first elongate truss element and a second elongate truss element, wherein said translating truss assembly is capable of being linearly moved in a first direction when said musical strings are in said detensioned state in order to selectively position said hinge proximate a junction between said lower and upper neck portions such that said lower and upper neck portions can be folded relative to one another about said hinge, and wherein said translating truss assembly is capable of being linearly moved in a second direction when said strings are in said detensioned state in order to position said lower neck portion or said upper neck portion across said junction between said lower and upper neck portions to maintain said lower and upper neck portions in linear alignment.

2. The travel guitar of claim 1, wherein said first direction of said translating bridge assembly is linearly away from said lower and upper neck portions and said second direction of said translating bridge assembly is linearly towards said lower and upper neck portions.

3. The travel guitar of claim 1, wherein said first direction of said translating truss assembly is linearly away from said lower and upper neck portions and said second direction of said translating truss assembly is linearly towards said lower and upper neck portions.

4. The travel guitar of claim 1, wherein said lower and upper neck portions are moveably coupled such that said lower and upper neck portions maybe folded relative to one another such that said generally flat surface of said lower neck portion is facing generally away from said generally flat surface of said upper neck portion.

5. The travel guitar of claim 1, wherein said lower and upper neck portions are rotatably moveable relative to one another after said musical strings are in said detensioned state and said hinge of said truss assembly is located proximate the junction of said lower and upper neck portions.

6. The travel guitar of claim 1, further comprising at least one on-board electrical component and at least one electrical connector to establish electrical communication between said at least one on-board electrical component and at least one external component.

7. The travel guitar of claim 6, wherein said at least one on-board component includes at least one of a power supply, an electrical pick-up for picking up electrical signals generated from playing of said musical strings, a microphone for transmitting sound generated from playing said musical strings, and a tuner for tuning said musical strings.

8. The travel guitar of claim 6, wherein said at least one connector for connecting at least one of headphones, a smart phone, a tablet computer, an external amplifier, and external power.

9. The travel guitar of claim 1, further including a recess dimensioned to receive a smart phone, wherein said smart phone is equipped with applications for driving at least one of an operation, a functionality and an effect associated with said travel guitar.

10. The travel guitar of claim 1, further comprising a body coupled to said lower neck portion, said body including a handle member coupled to said translating truss assembly and slidably arranged relative to said body so as to linearly move said translating truss assembly in said first direction and said second direction.

11. The travel guitar of claim 1, further comprising a body coupled to said lower neck portion, wherein said body includes at least one recess dimensioned to receive at least one of said translating bridge assembly and an actuation mechanism for selectively locking and unlocking said translating bridge assembly.

* * * * *